US011787177B2

(12) United States Patent
Aimono

(10) Patent No.: US 11,787,177 B2
(45) Date of Patent: Oct. 17, 2023

(54) LIQUID EJECTING HEAD AND LIQUID EJECTING APPARATUS

(71) Applicant: SEIKO EPSON CORPORATION, Tokyo (JP)

(72) Inventor: Takanori Aimono, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 87 days.

(21) Appl. No.: 17/445,644

(22) Filed: Aug. 23, 2021

(65) Prior Publication Data

US 2022/0063271 A1 Mar. 3, 2022

(30) Foreign Application Priority Data

Aug. 26, 2020 (JP) ..... 2020-142883

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2002/14419; B41J 2002/14491; B41J 2202/02; B41J 2/14233
See application file for complete search history.

(56) References Cited

U.S. PATENT DOCUMENTS

2014/0184698 A1 7/2014 Tadachi et al.

FOREIGN PATENT DOCUMENTS

JP 2014-124879 A 7/2014

OTHER PUBLICATIONS

IP.com search #1 (Year: 2023).*
IP.com search #2 (Year: 2023).*
Machine Translation of (WO 2010/021539) "Device for Generating Plasma Discharge for Patterning the Surface of a Substrate", p. 16-p. 18 line 10, Feb. 25, 2010, Blom, Paulus Petrus Maria (Year: 2010).*
Machine Translation of Sugawara, Hirota (JP 2009051039 A) "Liquid Droplet Transporting Device", Best Mode: First Embodiment, Paragraphs 0001-0031, Mar. 12, 2009 (Year: 2009).*

* cited by examiner

*Primary Examiner* — Lisa Solomon
(74) *Attorney, Agent, or Firm* — WORKMAN NYDEGGER

(57) ABSTRACT

A liquid ejecting head includes a plasma generator which includes a first electrode and a second electrode and in which an alternating voltage is applied to at least the first electrode to generate an atmospheric-pressure plasma around the first electrode. The atmospheric-pressure plasma accelerates the liquid ejected through the nozzle. The first electrode is disposed on a surface of the nozzle substrate in the ejection direction. The second electrode is disposed opposite the first electrode in the ejection direction.

17 Claims, 11 Drawing Sheets

LIQUID EJECTING HEAD AND LIQUID EJECTING APPARATUS

The present application is based on, and claims priority from JP Application Serial Number 2020-142883, filed Aug. 26, 2020, the disclosure of which is hereby incorporated by reference herein in its entirety.

BACKGROUND

1. Technical Field

The present disclosure relates to a liquid ejecting head and a liquid ejecting apparatus.

2. Related Art

As described in JP-A-2014-124879, a known liquid ejecting apparatus includes a liquid ejecting head configured to eject a liquid such as ink onto a medium.

In the known liquid ejecting apparatus of the related art, a medium being transported generates airflow, and the airflow deflects the liquid ejected through the nozzle away from the target landing position, resulting in lower image quality.

SUMMARY

To solve the above-described problem, a liquid ejecting head according to an aspect of the present disclosure includes a channel substrate having a channel through which a liquid flows, a nozzle substrate having a nozzle through which the liquid supplied through the channel is ejected in an ejection direction, the nozzle substrate being stacked on the channel substrate in the ejection direction, and a plasma generator which includes a first electrode and a second electrode and in which an alternating voltage is applied to at least the first electrode to generate an atmospheric-pressure plasma around the first electrode. The atmospheric-pressure plasma accelerates the liquid ejected through the nozzle. The first electrode is disposed on a surface of the nozzle substrate in the ejection direction, and the second electrode is disposed opposite the first electrode in the ejection direction.

Furthermore, a liquid ejecting head according to another aspect of the present disclosure includes a channel substrate having a channel through which a liquid flows, a nozzle substrate having a nozzle through which the liquid supplied through the channel is ejected in an ejection direction, the nozzle substrate being stacked on the channel substrate in the ejection direction, and a plasma generator which includes a first electrode and a second electrode and in which an alternating voltage is applied to at least the first electrode to generate an atmospheric-pressure plasma around the first electrode. The first electrode is disposed on a surface of the nozzle substrate in the ejection direction, the second electrode is disposed opposite the first electrode in the ejection direction, and the first electrode is farther than the second electrode from the nozzle in an intersecting direction intersecting the ejection direction.

Furthermore, a liquid ejecting apparatus according to another aspect of the present disclosure includes the liquid ejecting head and an ejection controller configured to control ejection from the liquid ejecting head.

DESCRIPTION OF EXEMPLARY EMBODIMENTS

Figure 1:
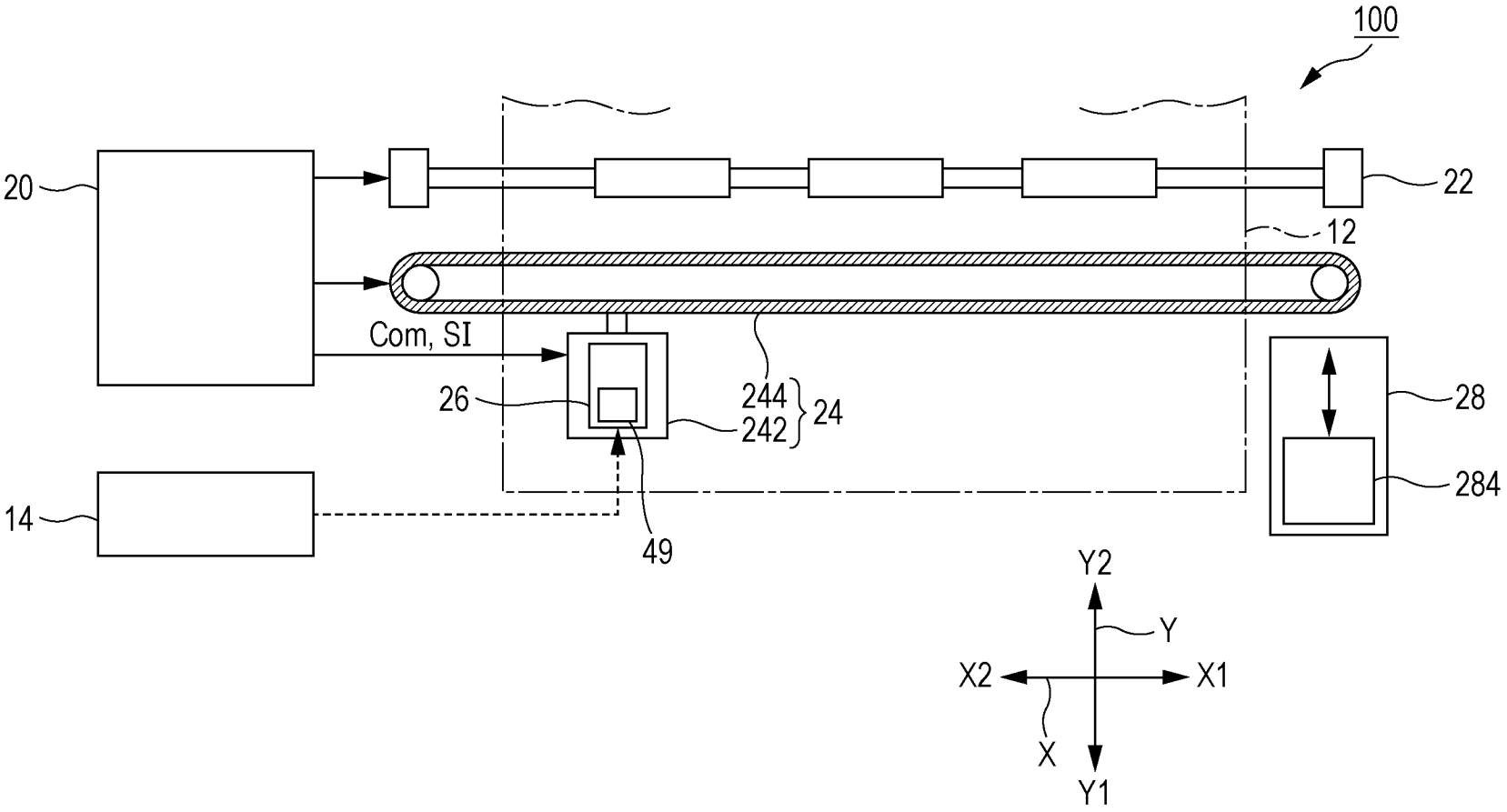
FIG. 1 is a schematic view of a liquid ejecting apparatus according to a first embodiment.

Hereinafter, embodiments of the present disclosure are described with reference to the drawings. In the drawings, the components are illustrated in different dimensions and different scale ratios from the actual components. Although various limitations technically preferable are made in the embodiments described below to illustrate desirable specific examples of the present disclosure, it should be noted that the scope of the disclosure is not limited to these embodiments unless such limitations are explicitly mentioned to limit the disclosure in the following description.

1. First Embodiment

FIG. 1 is a schematic view illustrating a liquid ejecting apparatus 100 according to a first embodiment. The liquid ejecting apparatus 100 according to the first embodiment is an ink jet printer that ejects ink, which is an example of a liquid, onto a medium 12. The medium 12 is typically a printing sheet, but the medium 12 may be any print target, such as a resin film and a fabric. Alternatively, the medium 12 may be a three-dimensional object. When the medium 12 is a three-dimensional object, the liquid ejecting apparatus 100 ejects ink onto a surface of the three-dimensional medium 12. The surface of the three-dimensional object may be flat or curved.

As illustrated in FIG. 1, the liquid ejecting apparatus 100 includes a liquid reservoir 14 configured to store ink. Examples of the liquid reservoir 14 include a cartridge detachable from the liquid ejecting apparatus 100, an ink pouch formed of a flexible film, and a refillable ink tank.

As illustrated in FIG. 1, the liquid ejecting apparatus 100 includes a control unit 20, a transportation mechanism 22, a movement mechanism 24, a liquid ejecting head 26, and a maintenance mechanism 28. The control unit 20 includes, for example, a processing circuit, such as a central processing unit (CPU) and a field programmable gate array (FPGA), and a memory circuit, such as a semiconductor memory to integrally control all the components of the liquid ejecting apparatus 100. The control unit 20 sends a drive signal Com for driving the liquid ejecting head 26 and a control signal SI for controlling the liquid ejecting head 26 to the liquid ejecting head 26. The liquid ejecting head 26 is driven by the drive signal Com under control of the control signal SI to eject ink through at least one of nozzles N of the liquid ejecting head 26. The transportation mechanism 22 transports the medium 12 along the Y axis under control of the control unit 20.

The movement mechanism 24 reciprocates the liquid ejecting head 26 along the X axis under control of the control unit 20. The X axis intersects the Y axis along which the medium 12 is transported. For example, the X axis and the Y axis intersect at a right angle. As indicated in FIG. 1, an "X1 direction" is a direction extending along the X axis as viewed from a certain point and an "X2 direction" is a direction opposite the X1 direction. The X1 and X2 directions are collectively referred to as the "X axis direction". In the same way, a "Y1 direction" is a direction extending along the Y axis as viewed from a certain point and a "Y2 direction" is a direction opposite the Y1 direction. The Y1 and Y2 directions are collectively referred to as the "Y axis direction".

The movement mechanism 24 in the first embodiment includes a carriage 242 having a box-like shape and housing the liquid ejecting head 26 and a transportation belt 244 to which the carriage 242 is fixed. The carriage 242 may house multiple liquid ejecting heads 26 or may house the liquid reservoir 14 in addition to the liquid ejecting head 26.

The liquid ejecting head 26 ejects ink, which is supplied from the liquid reservoir 14, onto the medium 12 through the nozzles N under control of the control unit 20. In other words, the control unit 20 controls ejection from the liquid ejecting head 26. The control unit 20 is an example of an "ejection controller". The liquid ejecting head 26 ejects ink onto the medium 12 while the medium 12 is being transported by the transportation mechanism 22 and the carriage 242 is being repeatedly reciprocated. This forms an image on a surface of the medium 12.

Furthermore, the liquid ejecting head 26 according to the first embodiment includes a plasma generator 49. The plasma generator 49 generates an atmospheric-pressure plasma.

Figure 2:
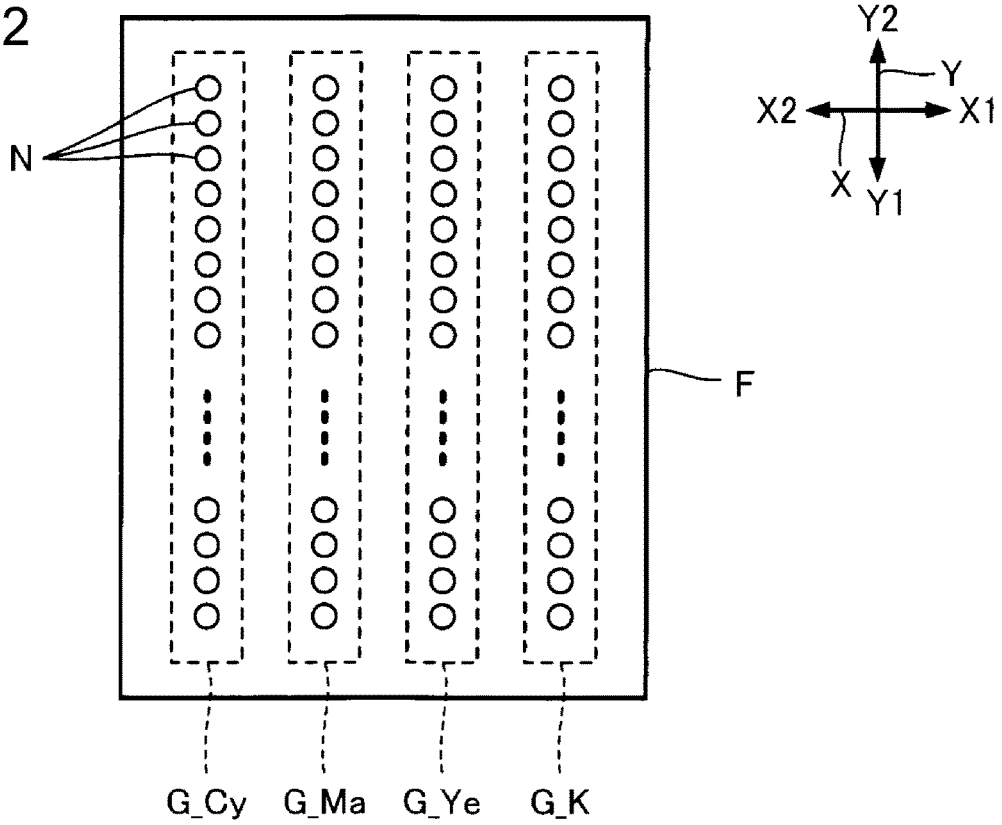
FIG. 2 is an explanatory view of an ejection surface of a liquid ejecting head facing a medium.

FIG. 2 is an explanatory view of an ejection surface F of the liquid ejecting head 26 facing the medium 12. As illustrated in FIG. 2, the ejection surface F of the liquid ejecting head 26 has nozzles N. The nozzles N are grouped into nozzle groups G according to types of inks. Specifically described, the ejection surface F has a nozzle group of cyan G_Cy, a nozzle group of magenta G_Ma, a nozzle group of yellow G_Ye, and a nozzle group of black G_K.

The nozzle groups G for cyan, magenta, yellow, and black inks each include multiple nozzles N through which the corresponding ink is ejected. Specifically described, the nozzle groups G each have nozzles N arranged in the Y axis direction and the nozzle groups G are spaced apart from each other in the X axis direction. The Y axis direction is an example of an "arrangement direction of nozzles". As can be understood from the above, in the liquid ejecting head 26 according to this embodiment, the different nozzle groups G having the multiple nozzles N eject different types of inks. The nozzles N in each of the nozzle groups G may be arranged in any pattern. For example, the nozzles N may be arranged in multiple lines.

Referring back to FIG. 1, the maintenance mechanism 28 cleans the liquid ejecting head 26 under control of the control unit 20. The maintenance mechanism 28 faces the ejection surface F when the liquid ejecting head 26 is positioned at a standby position where the ejection surface F does not face the medium 12. Specifically described, the standby position of the liquid ejecting head 26 corresponds to an end point of the reciprocating motion of the liquid ejecting head 26. The maintenance mechanism 28 of the present embodiment includes a wiping mechanism 284. The wiping mechanism 284 includes a wiper to be in contact with the ejection surface F. The wiping mechanism 284 is movable in the Y axis direction. The wiping mechanism 284 may be in first or second conditions described below. In the first condition, as illustrated in FIG. 1, the wiping mechanism 284 is positioned at an end in the Y1 direction in the maintenance mechanism 28. In the second condition, the wiping mechanism 284 is positioned at an end in the Y2 direction in the maintenance mechanism 28. While the liquid ejecting head 26 is positioned at the standby position, the wiping mechanism 284 is switched from the first condition to the second condition to wipe the ejection surface F along the Y axis.

1.1. Liquid Ejecting Head 26

Figure 3:
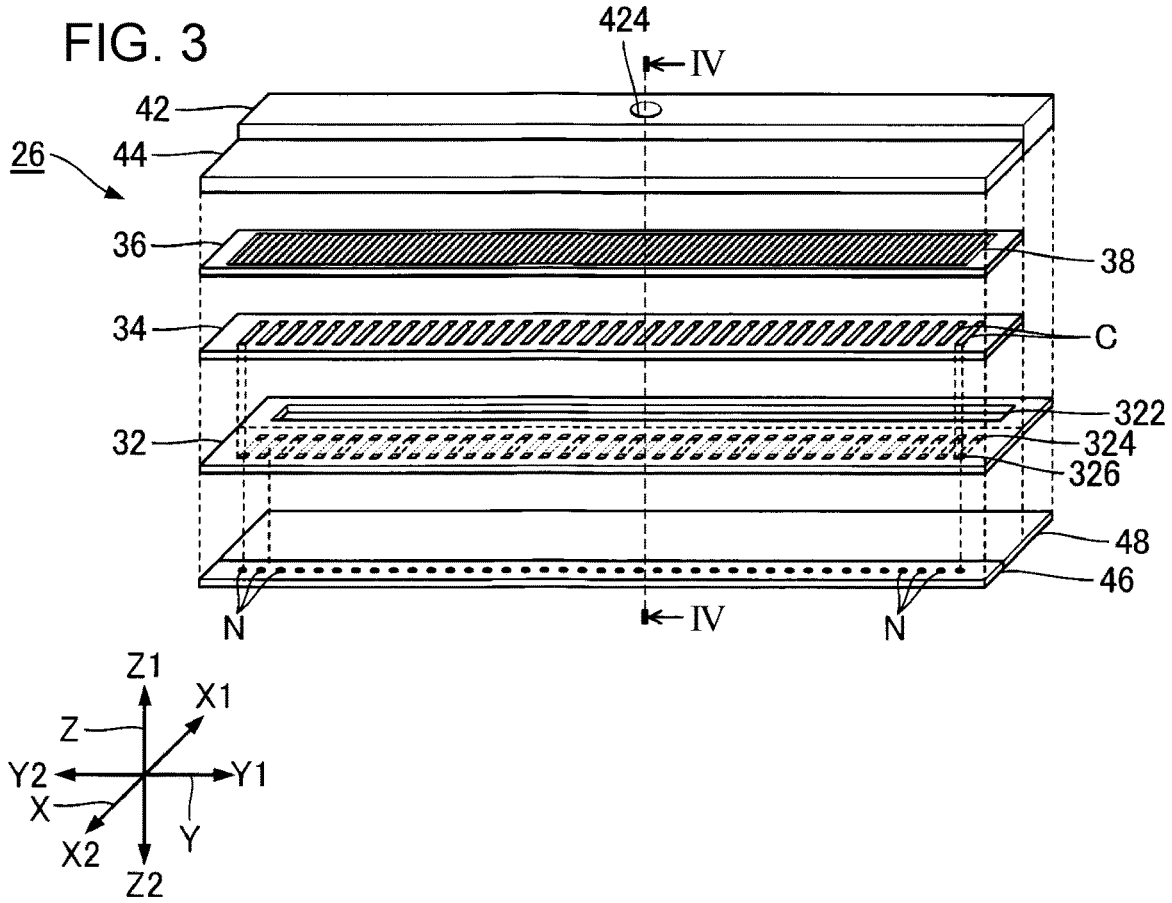
FIG. 3 is an exploded perspective view of the liquid ejecting head.
Figure 4:
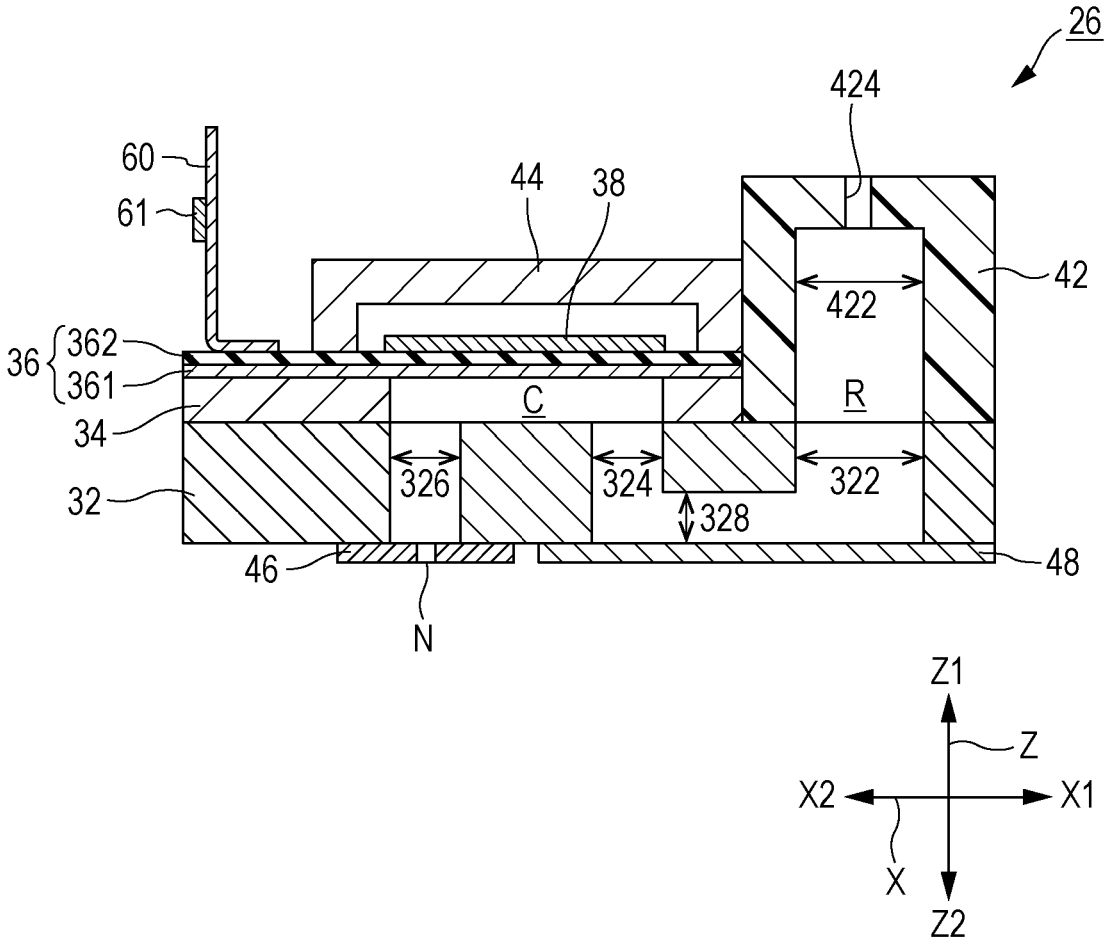
FIG. 4 is a sectional view taken along line IV-IV in FIG. 3.

FIG. 3 is an exploded perspective view of the liquid ejecting head 26. FIG. 4 is a sectional view taken along line IV-IV in FIG. 3. As indicated in FIG. 3, an axis perpendicular to the XY plane is a Z axis. The section in FIG. 4 is parallel to the XZ plane. The Z axis is an axial line extending in an ejection direction in which ink is ejected from the liquid ejecting head 26. As indicated in FIG. 3, a "Z1 direction" is a direction extending along the Z axis as viewed from a certain point and a "Z2 direction" is a direction opposite the Z1 direction. The Z1 and Z2 directions are collectively referred to as a "Z axis direction". The ejection direction corresponds to the Z2 direction.

As illustrated in FIGS. 3 and 4, the liquid ejecting head 26 includes a channel substrate 32 having a substantially rectangular shape elongated in the Y axis. A pressure chamber substrate 34, a vibration plate 36, piezoelectric elements 38, a housing 42, and a sealing member 44 are disposed on a surface of the channel substrate 32 facing in the Z1 direction. A nozzle substrate 46 and a vibration absorber 48 are disposed on a surface of the channel substrate 32 facing in the Z2 direction. The components of the liquid ejecting head 26 each have a plate-like shape elongated along the Y axis as the channel substrate 32 and the components are bonded together by, for example, an adhesive.

As illustrated in FIG. 3, the nozzle substrate 46 is a plate-like member having multiple nozzles N arranged along the Y axis. The nozzles N are through holes through which ink passes.

The channel substrate 32 is a plate-like member having channels through which ink flows. As illustrated in FIGS. 3 and 4, the channel substrate 32 has an opening 322, supply channels 324, and communication channels 326. The opening 322 is one through hole extending in the Y direction along the array of the nozzles N in plan view viewed in the Z axis direction. The supply channels 324 and the communication channels 326 are through holes provided for individual nozzles N. As illustrated in FIG. 4, the channel substrate 32 has a relay channel 328 opening in the Z2 direction and extending along the supply channels 324. The relay channel 328 is a channel that allows communication between the opening 322 and the supply channels 324.

The channel substrate 32 and the pressure chamber substrate 34 may be obtained by processing a silicon single-crystal substrate by using a semiconductor processing technology such as etching. Any material and any method may be employed to form the components of the liquid ejecting head 26.

The housing 42 is an injection-molded resin structure, for example, and is fixed to the surface of the channel substrate 32 facing in the Z1 direction. As illustrated in FIG. 4, the housing 42 has a chamber 422 and an inlet 424. The chamber 422 is a recess having an outline corresponding to the opening 322 in the channel substrate 32. The inlet 424 is a through hole in communication with the chamber 422. As can be seen in FIG. 4, the opening 322 in the channel substrate 32 and the chamber 422 in the housing 42 in communication with each other function as a liquid storage chamber R. The ink is supplied from the liquid reservoir 14 through the inlet 424 to be stored the liquid storage chamber R.

The vibration absorber 48 absorbs pressure variation in the liquid storage chamber R. The vibration absorber 48 includes, for example, a flexible sheet, which is elastically deformable. Specifically described, the vibration absorber 48 is disposed on a surface of the channel substrate 32 facing in the Z2 direction to close the opening 322, the relay channel 328, and the supply channels 324 in the channel substrate 32 and constitute a bottom surface of the liquid storage chamber R.

As illustrated in FIGS. 3 and 4, the pressure chamber substrate 34 is a plate-like component having pressure chambers C corresponding to the respective nozzles N. The pressure chambers C are spaced apart from each other along the Y axis. The pressure chambers C are openings each elongated along the X axis. The pressure chamber C overlaps one of the supply channels 324 at one end in the X1 direction in plan view and overlaps one of the communication channels 326 in the channel substrate 32 at one end in the X2 direction in plan view.

The vibration plate 36 is disposed on a surface of the pressure chamber substrate 34 opposite the surface facing the channel substrate 32. The vibration plate 36 is an elastically deformable plate-like component. As illustrated in FIG. 4, the vibration plate 36 in the first embodiment is a stack of an elastic film 361 and an insulating film 362. The insulating film 362 is disposed on a side of the elastic film 361 opposite a side on which the pressure chamber substrate 34 is disposed. The elastic film 361 is formed of silicon oxide, for example. The insulating film 362 is formed of zirconium oxide, for example.

As can be seen in FIG. 4, the channel substrate 32 and the vibration plate 36 face each other through the pressure chambers C with a predetermined distance therebetween. The pressure chambers C are spaces between the channel substrate 32 and the vibration plate 36. A pressure is applied to the ink filed in the pressure chambers C. The vibration plate 36 partially constitutes a wall of the pressure chamber C. The ink stored in the liquid storage chamber R flows through the relay channel 328 to the supply channels 324. Then, the ink is supplied in parallel to separately fill the pressure chambers C. In other words, the liquid storage chamber R functions as a common liquid chamber from which the ink is supplied to the multiple pressure chambers C.

As illustrated in FIGS. 3 and 4, the piezoelectric elements 38 for the respective nozzles N are disposed on a surface of the vibration plate 36 opposite the surface on which the pressure chamber substrate 34 is disposed. The piezoelectric elements 38 are actuators to be deformed by supply of driving signals Com and each have a shape elongated along the X axis. The piezoelectric elements 38 are arranged along the Y axis to correspond to the pressure chambers C. The vibration plate 36 is vibrated by deformation of the piezoelectric elements 38. This changes the pressure in the pressure chambers C, allowing the ink filled in the pressure chambers C to be ejected through the nozzles N via the communication channels 326. In other words, the piezoelectric elements 38 are driving elements that vibrate the vibration plate 36 to eject the ink in the pressure chambers C through the nozzles N.

As illustrated in FIGS. 3 and 4, the sealing member 44 is a structure that protects the piezoelectric elements 38 from the outside air and improves the mechanical strength of the pressure chamber substrate 34 and the vibration plate 36. The sealing member 44 is fixed to the surface of the vibration plate 36 with an adhesive, for example. The sealing member 44 has a recess in a surface facing the vibration plate 36 and the piezoelectric elements 38 are housed in the recess.

As illustrated in FIG. 4, a wiring board 60 is bonded to the vibration plate 36. The wiring board 60 is a surface mount device having multiple wiring lines that electrically couple the control unit 20 to the liquid ejecting head 26. Desirable examples of the wiring board 60 include a flexible printed circuit (FPC) and a flexible flat cable (FFC). A driving circuit 61 is mounted on the wiring board 60. The driving circuit 61 is an electric circuit for switching on and off the supply of a driving signal Com to the piezoelectric elements 38 under control of the control signal SI.

1.2. Plasma Generator 49

Figure 5:
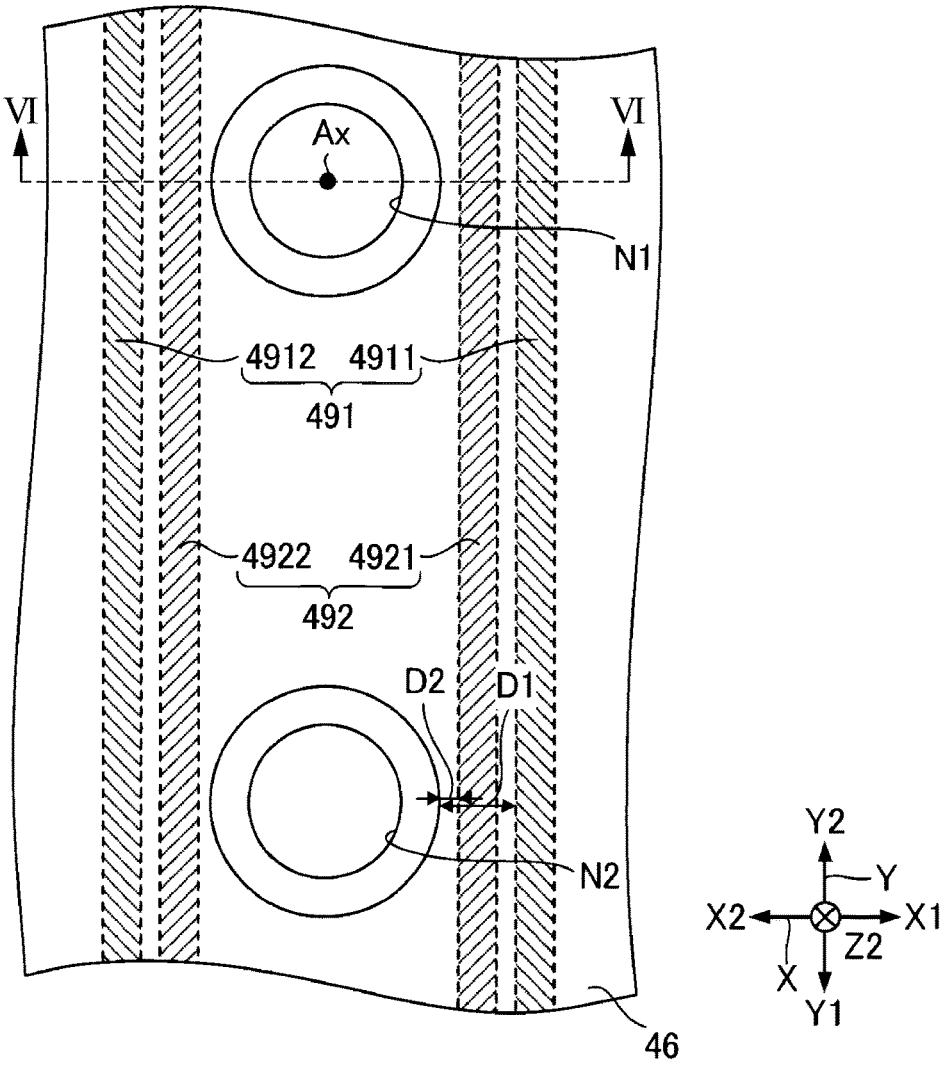
FIG. 5 is a magnified plan view of adjacent two nozzles and the surrounding area.
Figure 6:
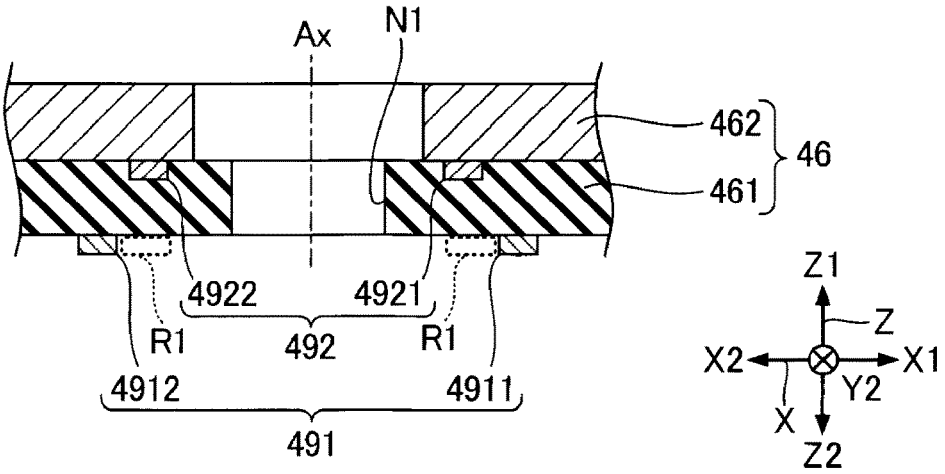
FIG. 6 is a sectional view taken along line VI-VI in FIG. 5.

The nozzles N and the surrounding area will be specifically described below to explain the plasma generator 49. FIG. 5 is a magnified plan view of a nozzle N1, which is any one of the nozzles N, a nozzle N2 adjacent to the nozzle N1 in the Y1 direction, and the surrounding area. The plan view in FIG. 5 illustrates the nozzles N1 and N2 viewed in the Z2 direction. FIG. 6 is a sectional view taken along line VI-VI in FIG. 5. The line VI-VI is an imaginary line extending in the X axis direction through the central axis Ax of the nozzle N1. In the following description, the nozzles N1 and N2 are collectively referred to as the nozzles N in some cases. The nozzle N1 is an example of a "first nozzle". The nozzle N2 is an example of a "second nozzle".

As illustrated in FIGS. 5 and 6, the nozzle substrate 46 includes a first substrate 461 and a second substrate 462 stacked on a surface of the first substrate 461 facing in the Z1 direction. The nozzle substrate 46 includes at least one of silicon, silicon oxide, silicon nitride, and a photocurable resin. For example, the first substrate 461 is an insulator and may be formed of SU-8. The second substrate 462 may be obtained by processing a monocrystalline silicon substrate by using a semiconductor manufacturing technology such as etching.

The nozzle N is a through hole extending through the first and second substrates 461 and 462. As illustrated in FIG. 6, the diameter of the nozzle N decreases in the Z2 direction. Specifically described, the diameter of the nozzle N is larger in the second substrate 462 than in the first substrate 461.

As illustrated in FIGS. 5 and 6, a first electrode 491 and a second electrode 492, which constitute the plasma generator 49, are disposed on the nozzle substrate 46. An insulating member is disposed between the first electrode 491 and the second electrode 492 and no conductive member is disposed therebetween.

In FIG. 5, although the first and second electrodes 491 and 492 are not visible, the outlines of the first and second electrodes 491 and 492 are indicated by broken lines to indicate the position relative to the nozzles N. In FIG. 5, diagonal lines from upper left to lower right indicate the first electrode 491 and diagonal lines from upper right to lower left indicate the second electrode 492. As illustrated in FIG. 6, the first electrode 491 is disposed on a surface of the nozzle substrate 46 facing in the ejection direction or on the ejection surface F. The first electrode 491 is exposed to the atmosphere. As illustrated in FIG. 6, the second electrode 492 is disposed between the first substrate 461 and the second substrate 462. In an example in FIG. 6, the first substrate 461 has a groove opening in the Z1 direction and the second electrode 492 is disposed in the groove. Alternatively, the second substrate 462 may have a groove opening in the Z2 direction and the second electrode 492 may be disposed in the groove.

As illustrated in FIG. 5, the first electrode 491 has a first electrode portion 4911 and a second electrode portion 4912. The second electrode 492 has a first electrode portion 4921 and a second electrode portion 4922. The first electrode portions 4911 and 4921 are located in the X1 direction with respect to the nozzle N1 and extend in the Y axis direction, which is an arrangement direction of the nozzles N1 and N2. The second electrode portions 4912 and 4922 are located in the X2 direction with respect to the nozzle N1 and extend in the Y axis direction. The X axis direction is a direction intersecting the ink ejection direction and the arrangement direction of the nozzles N. The first and second electrode portions 4911, 4912, 4921, and 4922 are metal members having a flat rectangular shape extending in the Y axis direction. The first electrode portions 4911 and 4921 are examples of a "first portion". The second electrode portions 4912 and 4922 are examples of a "second portion".

Furthermore, as illustrated in FIG. 5, the first electrode 491 is farther than the second electrode 492 from the nozzle N in the direction along the XY plane. In other words, the second electrode 492 is positioned between the nozzles N and the first electrode 491 in the XY plane direction. The XY plane direction is an example of a direction intersecting the ejection direction. The XY plane direction is the X axis direction, for example. The positions of the first and second electrodes 491 and 492 relative to the nozzle N are defined by the shortest distance from the wall of the nozzle N. As illustrated in FIG. 5, the shortest distance D1 from the first electrode portion 4911 of the first electrode 491 to the wall of the nozzle N2 is longer than the shortest distance D2 from the first electrode portion 4921 of the second electrode 492 to the wall of the nozzle N2 in the X1 direction. The operation of the plasma generator 49 will be described with reference to FIG. 7.

Figure 7:
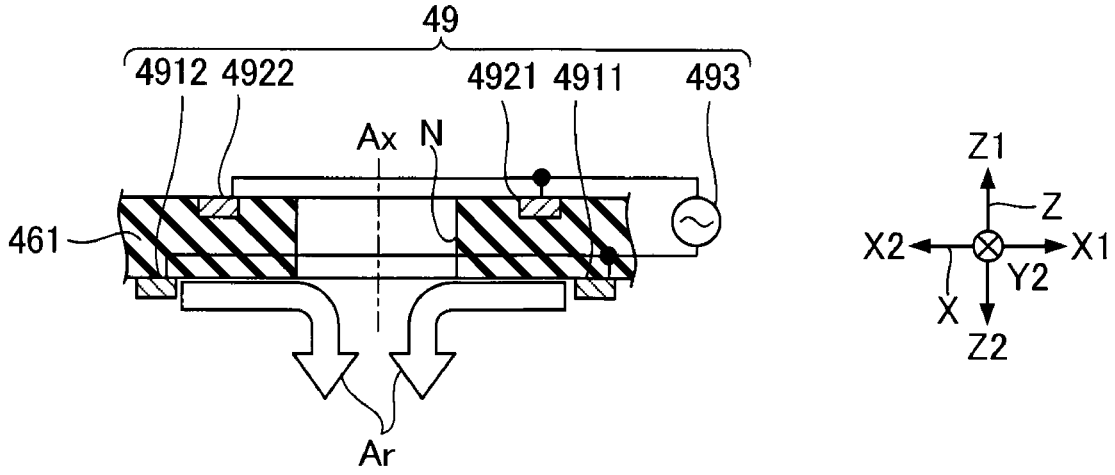
FIG. 7 is a view illustrating an example of operation of a plasma generator.

FIG. 7 illustrates an example of operation of the plasma generator 49. In FIG. 7, the second substrate 462 is not illustrated to simplify the drawing. As illustrated in FIG. 7, the plasma generator 49 includes the first electrode 491 including the first and second electrode portions 4911 and 4912, the second electrode 492 including the first and second electrode portions 4921 and 4922, and an AC source 493. The AC source 493 is electrically coupled to the first and second electrode portions 4911 and 4912 at one side and electrically coupled to the first and second electrode portions 4921 and 4922 at the other side. The AC source 493 generates an alternating voltage by using a battery power supply or a utility power, which are not illustrated. In the plasma generator 49, an alternating voltage is applied in accordance with one of the following first and second modes under control of the driving circuit 61. This causes electrical breakdown of the air around the first electrode 491, allowing the elements of the air to be ionized to generate the atmospheric-pressure plasma around the first electrode 491.

In the plasma generator 49 in the first mode, a fixed voltage is applied to the second electrode 492 and an alternating voltage of few kilovolts is applied by the AC source 493 to the first electrode 491 to generate the atmospheric-pressure plasma around the first electrode 491. In the plasma generator 49 in the second mode, an alternating voltage of few kilovolts is applied by the AC source 493 to the first and second electrodes 491 and 492 to generate the atmospheric-pressure plasma around the first electrode 491. In the plasma generator 49 in any of the first and second modes, an alternating voltage is applied at least to the first electrode 491. In the following description, the plasma generator 49 in the first mode will be described.

The portion around the first electrode 491 is all or a part of an area R1 indicated in FIG. 6. The area R1 is located at the same position in the Z axis direction as the first electrode 491 and located between the first electrode 491 and the second electrode 492 when viewed in the Z2 direction.

In the plasma generator 49, an alternating voltage not exceeding the electrical breakdown voltage of the first substrate 461 is applied to generate an atmospheric-pressure plasma. The electrical breakdown voltage of an insulator is a voltage at which the insulator becomes conductive. Typically, the electrical breakdown voltage increases as the thickness of the insulator increases. The first substrate 461 withstands an alternating voltage at least 1.5 times higher than the alternating voltage applied by the plasma generator 49 without undergoing electrical breakdown.

The arrows Ar indicated in FIG. 7 indicate the airflows generated by the atmospheric-pressure plasma. The atmospheric-pressure plasma generated around the first electrode 491 flows toward the second electrode 492, and thus the airflows directed toward the central axis Ax of the nozzle N are generated as indicated by the arrows Ar. The airflows collide each other at the central axis Ax to generate a ring-shaped jet flowing along the central axis Ax or in the Z2 direction. Here, the jet is a stream of fluid that comes quickly out of a small hole in a substantially one direction. In the following description, the stream generated by the plasma generator 49 is referred to as a "jet stream".

The plasma generator 49 generates an atmospheric-pressure plasma after ink is ejected through the nozzle N and before a predetermined time passes. The plasma generator 49 preferably generates an atmospheric-pressure plasma immediately after the ink is ejected through the nozzle N. The predetermined time is a period from the ejection of ink through the nozzle to the landing of the ink on the medium 12. For example, the manufacturer of the liquid ejecting head 26 calculates an average length of time the ink from the nozzle N takes to reach the medium 12 in advance. The manufacturer of the liquid ejecting head 26 stores the information including the calculated average length of time in a memory accessible by the driving circuit 61.

Referring to a specific operation of the plasma generator 49, the driving circuit 61 specifies when the ink is ejected through the nozzle N by using the driving signal Com and the control signal SI. The driving circuit 61 controls the plasma generator 49 such that an atmospheric-pressure plasma is generated after the specified moment and before a predetermined time passes. Instead of the driving circuit 61, the control unit 20 may specify when the ink is ejected through the nozzle N and control the plasma generator 49.

1.3. Summary of First Embodiment

As described above, the liquid ejecting head 26 according to the first embodiment includes the channel substrate 32 having channels through which the ink flows, the nozzle substrate 46, and the plasma generator 49. The ink is an example of a "liquid". The nozzle substrate 46 has the nozzles N through which the ink supplied through the channels is ejected in the ejection direction. The nozzle substrate 46 is stacked on a surface of the channel substrate 32 facing in the ejection direction. The plasma generator 49 includes the first electrode 491 and the second electrode 492 and an alternating voltage is applied to at least the first electrode 491 to generate an atmospheric-pressure plasma around the first electrode 491. The plasma generator 49 accelerates the ink ejected through the nozzles N by using the jet stream of the atmospheric-pressure plasma. The first electrode 491 is disposed on a surface of the nozzle substrate 46 facing in the ejection direction, and the second electrode 492 is disposed opposite the first electrode 491 in the ejection direction.

Typically, an airflow generated by transportation of the medium 12 reduces the landing accuracy of ink. Hereinafter, the airflow generated by transportation of the medium 12 is referred to as a "transportation airflow". A smaller liquid droplet from the nozzle N will be more affected by the transportation airflow, resulting in low landing accuracy. Furthermore, higher speed transportation of the medium 12 will generate a greater transportation airflow, resulting in lower landing accuracy. To overcome these problems, according to the first embodiment, as illustrated in FIG. 7, the plasma generator 49 generates a jet stream directed in the Z2 direction. The jet stream accelerates the ejected ink, increasing the ejection speed of the ink. Due to the increased ejection speed, the ink is less affected by the airflow generated by the transportation of the medium 12. This improves the landing accuracy and the image quality. A specific example of the ejection speed will be explained with reference to FIG. 8.

Figure 8:
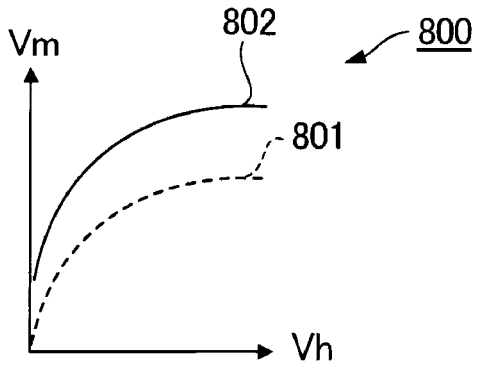
FIG. 8 is a graph indicating a relationship between voltages and ejecting speeds.

FIG. 8 indicates a relationship between voltages and ejection speeds. The graph 800 in FIG. 8 indicates the ejection speed Vm corresponding to the voltages Vh applied to the piezoelectric elements 38. The ejection speed Vm monotonically increases as the voltage Vh increases. However, the degree of increase in the ejection speed Vm monotonically decreases as the voltage Vh increases. Furthermore, meniscus in the nozzle N shifts in the Z1 direction as the voltage Vh increases, and the ejection becomes unstable because the diameter of the nozzle N increases in the Z1 direction. Improvements in rigidity and displacement characteristic or flexibility of the vibration plate 36 increase the ejection speed Vm without an increase in the voltage Vh. However, the improvement in rigidity of the vibration plate 36 requires the vibration plate 36 to be bigger to maintain the displacement characteristic of the vibration plate 36, making the liquid ejecting head 26 bigger.

An ejection speed characteristic 801 indicated in the graph 800 is a characteristic of ejection speed not accelerated by the jet stream. An ejection speed characteristic 802 in the graph 800 is a characteristic of the ejection speed in the first embodiment, i.e., accelerated by the jet stream. As indicated in the graph 800, due to the acceleration by the jet stream, the ejection speed Vm in the first embodiment is higher at any voltage Vh than the ejection speed Vm not accelerated by the jet stream.

Furthermore, the increase in the ejection speed reduces the possibility that a foreign substance will enter the liquid ejecting head 26 through the nozzle N. Furthermore, the medium 12 may be a three-dimensional object having a curved surface. In such a case, the distance between the ejection surface F and the medium 12 may be long. In the first embodiment, due to the increase in the ejection speed, landing accuracy is high even if the distance between the ejection surface F and the medium is long.

The liquid droplet of the ejected ink is elongated without being shaped into a ball in some cases. Hereinafter, this phenomenon is referred to as a "tailing phenomenon". The tailing phenomenon increases the possibility that the ink ejected through the nozzle N will land onto the medium 12 at a position away from a target position, compared with a case without the tailing phenomenon. In the first embodiment, the jet stream reduces the possibility that the tailing phenomenon will occur, and thus the image quality is high.

Furthermore, in the first embodiment, the liquid ejecting head 26 includes the plasma generator 49. In contrast to a case in which the liquid ejecting head 26 and the plasma generator 49 are separate members, the first embodiment achieves downsizing of the liquid ejecting head 26 as well as the improvement in ejection speed and the improvement in image quality.

Furthermore, the first electrode 491 has the first electrode portion 4911 and the second electrode portion 4912. The first electrode portion 4911 is located in the X1 direction with respect to the nozzle N1 and extends in the Y axis direction, which is the arrangement direction of the nozzles N. The X1 direction is an example of "one of two directions intersecting the ejection direction and the arrangement direction of the nozzles N". The second electrode portion 4912 is located in the X2 direction with respect to the nozzle N1 and extends in the Y axis direction. The X2 direction is an example of "the other of the two directions". The first electrode portion 4911 is an example of a "first portion". The second electrode portion 4912 is an example of a "second portion".

According to the first embodiment, the first and second electrode portions 4911 and 4912 extend in the Y axis direction. The wiping direction in which the wiping mechanism 284 wipes the ejection surface F corresponds to the Y axis direction. Thus, the wiping direction of the wiping mechanism 284 and the extending direction of the first and second electrode portions 4911 and 4912 are the same. Although the first and second electrode portions 4911 and 4912 protrude from the ejection surface F, this configuration in which the wiping direction of the wiping mechanism 284 and the extending direction of the first and second electrode portions 4911 and 4912 are the same reduces the external force applied to the first and second electrode portions 4911 and 4912 during wiping with the wiping mechanism 284. Thus, abrasion of the first and second electrode portions 4911 and 4912 is reduced. As described above, the first and second electrode portions 4911 and 4912 in the first embodiment are less abraded during wiping with the wiping mechanism 284 than those in a configuration in which the wiping direction of the wiping mechanism 284 intersects the extending direction of the first and second electrode portions 4911 and 4912.

Furthermore, the second electrode 492 includes the first and second electrode portions 4921 and 4922. The first electrode portion 4921 is located in the X1 direction with respect to the nozzle N1 and extends in the Y axis direction, which is the arrangement direction of the nozzles N. The second electrode portion 4922 is located in the X2 direction with respect to the nozzle N1 and extends in the Y axis direction. The first electrode portion 4921 is an example of a "first portion". The second electrode portion 4922 is an example of a "second portion".

In the first embodiment, the first and second electrode portions 4921 and 4922 are shared by the nozzles N arranged in the Y axis direction, eliminating the need for different wiring lines for different nozzles N arranged in the Y axis direction. This simplifies the wiring design.

Furthermore, the nozzle substrate 46 includes the first substrate 461 and the second substrate 462 stacked on a surface of the first substrate 461 facing in a direction opposite the ejection direction. The second electrode 492 is disposed between the first substrate 461 and the second substrate 462. In the first embodiment, the second substrate 462 does not affect the generation of atmospheric-pressure plasma, and thus the second substrate 462 has a higher degree of freedom in design.

Furthermore, the first electrode 491 is exposed to the atmosphere. This configuration enables the plasma generator 49 to generate an atmospheric-pressure plasma around the first electrode 491.

Furthermore, in the plasma generator 49, an alternating voltage not exceeding the electrical breakdown voltage of the first substrate 461 is applied to generate an atmospheric-pressure plasma. In the first embodiment, the first substrate 461 is a component between the first electrode 491 and the second substrate 492. If the first substrate 461 undergoes electrical breakdown, an alternating current will flow through the first substrate 461, but the air around the first electrode 491 will not undergo electrical breakdown. Thus, a jet stream is not generated. In the plasma generator 49, an alternating voltage not exceeding the electrical breakdown voltage of the first substrate 461 is applied to allow the air around the first electrode 491 undergo the electrical breakdown and generate the jet stream.

Furthermore, the first substrate 461 is an insulator. If the first substrate 461 is conductive, the air around the first electrode 491 will not undergo the electrical breakdown, and thus the jet stream is not generated. In this configuration in which the first substrate 461 is an insulator, application of an alternating voltage in the plasma generator 49 causes electrical breakdown of the air around the first electrode 491, and thus the jet stream is generated.

Furthermore, the nozzle substrate 46 includes at least one of silicon, silicon oxide, silicon nitride, and a photocurable resin. Silicon, silicon oxide, silicon nitride, and a photocurable resin are insulators. The manufacturer of the liquid ejecting head 26 selects the material of the nozzle substrate 46 from silicon, silicon oxide, silicon nitride, and a photocurable resin.

Furthermore, the plasma generator 49 generates an atmospheric-pressure plasma after ink is ejected through the nozzle N and before a predetermined time passes. In the first embodiment, the ejection speed of ink is increased by the jet stream before the ink is landed onto the medium 12.

Furthermore, the liquid ejecting apparatus 100 includes the liquid ejecting head 26 and the control unit 20. The control unit 20 is an example of an "ejection controller". According to the first embodiment, the liquid ejecting apparatus 100 that ejects ink at a higher speed and forms a higher-quality image is provided.

2. Second Embodiment

In the first embodiment, the first and second electrodes 491 and 492 extend in the Y axis direction. The second embodiment differs from the first embodiment in that first and second electrodes 491*a* and 492*a* are provided for the individual nozzles N to surround the individual nozzles N. Hereinafter, the second embodiment will be described.

2.1. Plasma Generator 49*a* in Second Embodiment

Figure 9:
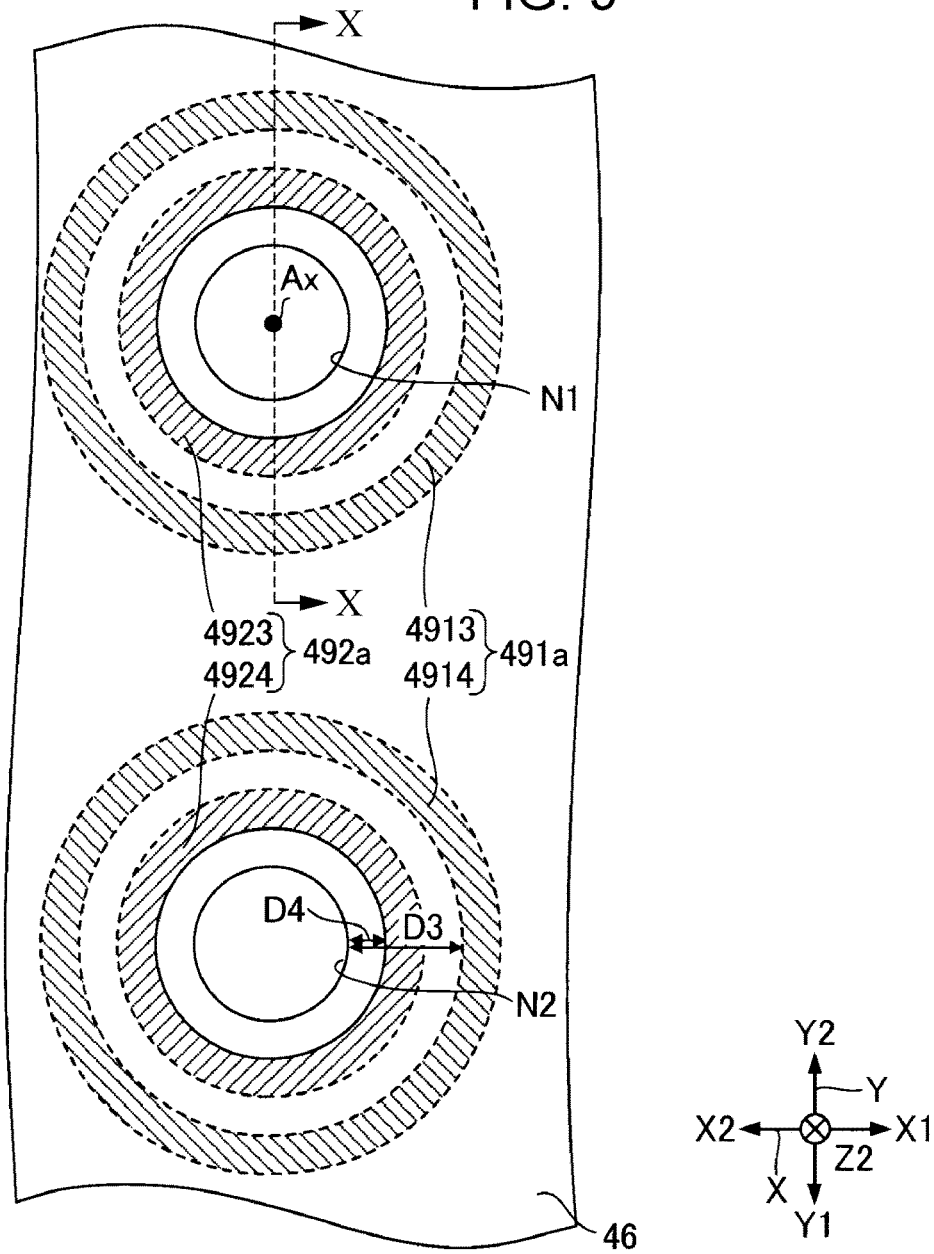
FIG. 9 is a magnified plan view of adjacent two nozzles and the surrounding area according to a second embodiment.
Figure 10:
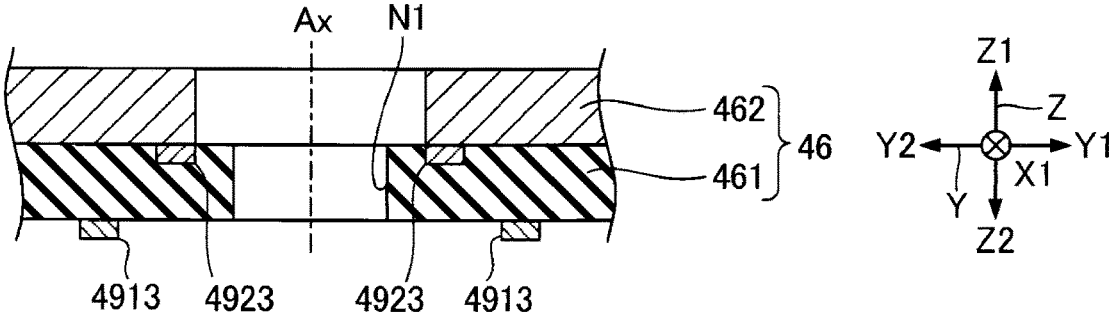
FIG. 10 is a sectional view taken along line X-X in FIG. 9.

The nozzles N and the surrounding area will be specifically described below to explain the plasma generator 49*a*. FIG. 9 is a plan view of the nozzles N1 and N2 and the surrounding area. In the plan view in FIG. 9, the nozzles N1 and N2 are viewed in the Z2 direction. FIG. 10 is a sectional view taken along line X-X in FIG. 9. The line X-X is an imaginary line extending in the Y axis direction through the central axis Ax of the nozzle N1.

As illustrated in FIGS. 9 and 10, the nozzle substrate 46 according to the second embodiment includes a first electrode 491*a* and a second electrode 492*a* of the plasma generator 49*a*. In FIG. 9, although the first and second electrodes 491*a* and 492*a* are not visible, the outlines of the first and second electrodes 491*a* and 492*a* are indicated by broken lines to indicate the position relative to the nozzles N. In FIG. 9, diagonal lines from upper left to lower right indicate the first electrode 491*a* and diagonal lines from upper right to lower left indicate the second electrode 492*a*. As illustrated in FIG. 9, the first electrode 491*a* is disposed on a surface of the nozzle substrate 46 facing in the ejection direction or on the ejection surface F. The first electrode 491*a* is exposed to the atmosphere. As illustrated in FIG. 10, the second electrode 492*a* is disposed between the first substrate 461 and the second substrate 462.

As illustrated in FIG. 9, the first electrode 491*a* and the second electrode 492*a* are provided for the individual nozzles N to surround the individual nozzles N. Specifically described, the first electrode 491*a* includes a third electrode portion 4913 and a fourth electrode portion 4914. In the same way, the second electrode 492*a* includes a third electrode portion 4923 and a fourth electrode portion 4924. The third electrode portions 4913 and 4923 surround the nozzle N1. The fourth electrode portions 4914 and 4924 surround the nozzle N2. The third electrode portion 4913, the fourth electrode portion 4914, the third electrode portion 4923, and the fourth electrode portion 4924 are metal members each having a flat ring shape centered at the central axis Ax of the nozzle N. The third electrode portions 4913 and 4923 are examples of a "third portion". The fourth electrode portions 4914 and 4924 are examples of a "fourth portion".

As in the first embodiment, as illustrated in FIG. 9, the first electrode 491*a* is farther than the second electrode 492*a* from the nozzle N in the direction along the XY plane. As illustrated in FIG. 9, the shortest distance D3 in the X1 direction from the fourth electrode portion 4914 of the first electrode 491*a* to the wall of the nozzle N2 is longer than the shortest distance D4 from the fourth electrode portion 4924 of the second electrode 492*a* to the wall of the nozzle N2. The operation of the plasma generator 49*a* is explained with reference to FIG. 11.

Figure 11:
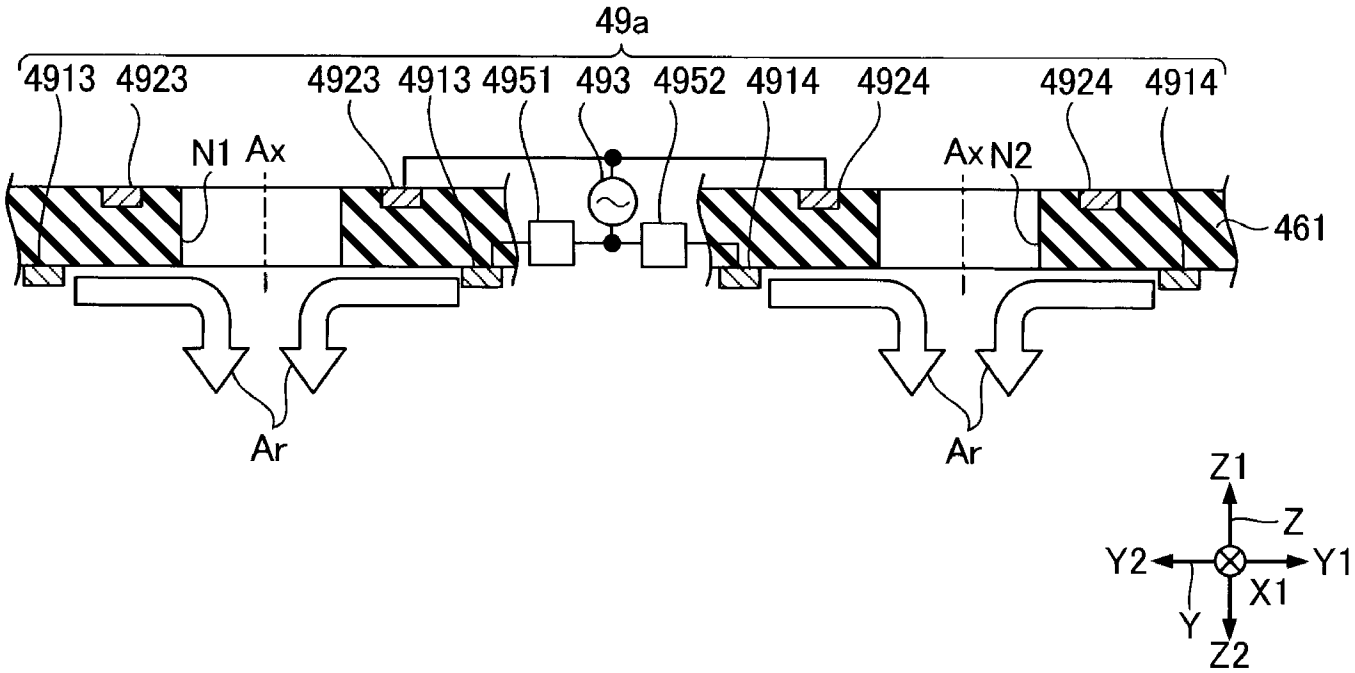
FIG. 11 is a view illustrating an example of operation of a plasma generator.

FIG. 11 illustrates an example of operation of the plasma generator 49*a*. In FIG. 11, the second substrate 462 is not illustrated to simplify the drawing. As illustrated in FIG. 11, the plasma generator 49*a* includes the third and fourth electrode portions 4913 and 4914 of the first electrode 491*a*, the third and fourth electrode portions 4923 and 4924 of the second electrode 492*a*, an AC source 493, a switching circuit 4951, and a switching circuit 4952. The AC source 493 is electrically coupled to the third electrode portions 4913 and 4923 at one side and electrically coupled to the fourth electrode portions 4914 and 4924 at the other side. The switching circuit 4951 is disposed between the AC source 493 and the third electrode portion 4913 and switches between a conducting state that allows current flow between the AC source 493 and the third electrode portion 4913 and a non-conducting state that prevents current flow therebetween. The switching circuit 4952 is disposed between the AC source 493 and the fourth electrode portion 4914 and switches between a conducting state that allows current flow between the AC source 493 and the fourth electrode portion 4914 and a non-conducting state that prevents current flow therebetween.

In the second embodiment, when a jet stream needs to be generated only at the nozzle N1, the plasma generator 49*a* controls the switching circuit 4951 to be in a conducting state that allows current flow between the AC source 493 and the third electrode portion 4913 and allows an alternating voltage to be applied to the third electrode portion 4913. This generates a jet stream only at the nozzle N1 and does not generate a jet stream at the other nozzles N, such as the nozzle N2. In this way, in the second embodiment, among the nozzles N, a jet stream is generated at the selected nozzle N.

2.2. Summary of Second Embodiment

As described above, as in the first embodiment, the first electrode 491*a* in the second embodiment is farther than the second electrode 492*a* from the nozzle N in the intersecting direction intersecting the ejection direction. In this configuration in which the first electrode 491*a* is farther than the second electrode 492*a* from the nozzle N, an airflow flowing from the first electrode 491*a* toward the second electrode 492*a* or from the first electrode 491*a* toward the nozzle N is generated.

Furthermore, as illustrated in FIG. 9, the first electrode 491*a* and the second electrode 492*a* are provided for the individual nozzles N to surround the individual nozzles N. In this configuration in which the first and second electrodes 491*a* and 492*a* surround the individual nozzles N, the airflows flowing from the first electrode 491*a* toward the nozzle N collide each other at the central axis Ax of the nozzle N, generating a jet stream flowing in the Z2 direction. Furthermore, in the second embodiment, the first and second electrodes 491*a* and 492*a* surround the individual nozzles N. This enables the amount of air flowing from the first electrode 491*a* toward the nozzle N to be larger than that in the first embodiment, generating a greater jet stream.

3. Third Embodiment

In the second embodiment, the first electrode 491*a* and the second electrode 492*a* are provided for the individual nozzles N to surround the individual nozzles N. In contrast, the third embodiment differs from the second embodiment in that the first and second electrodes 491*b* and 492*b* each have portions surrounding the nozzles N and a portion coupling the surrounding portions together. The third embodiment will be described below.

3.1. Plasma Generator 49*b* in Third Embodiment

Figure 12:
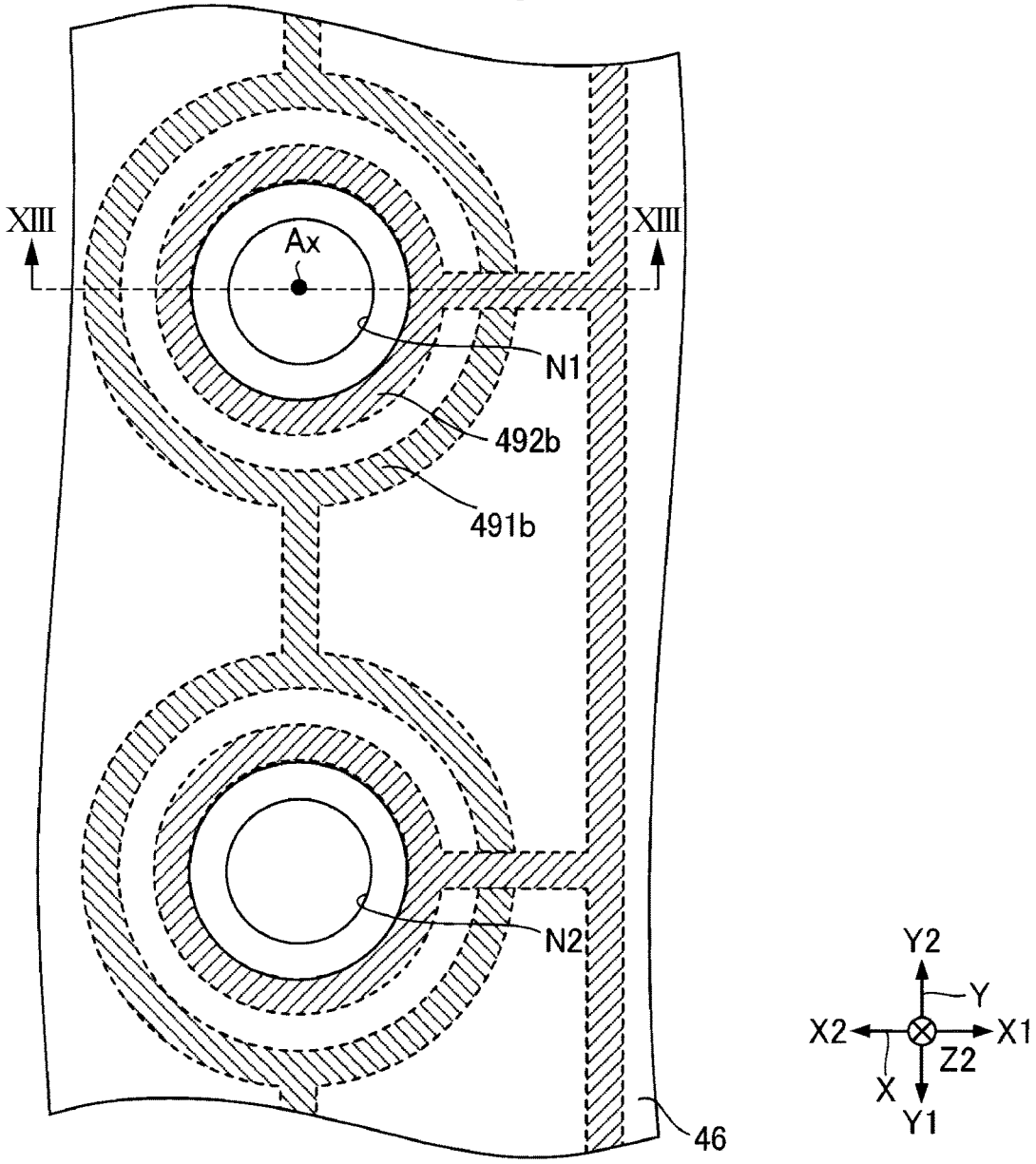
FIG. 12 is a magnified plan view illustrating adjacent two nozzles and the surrounding area.
Figure 13:
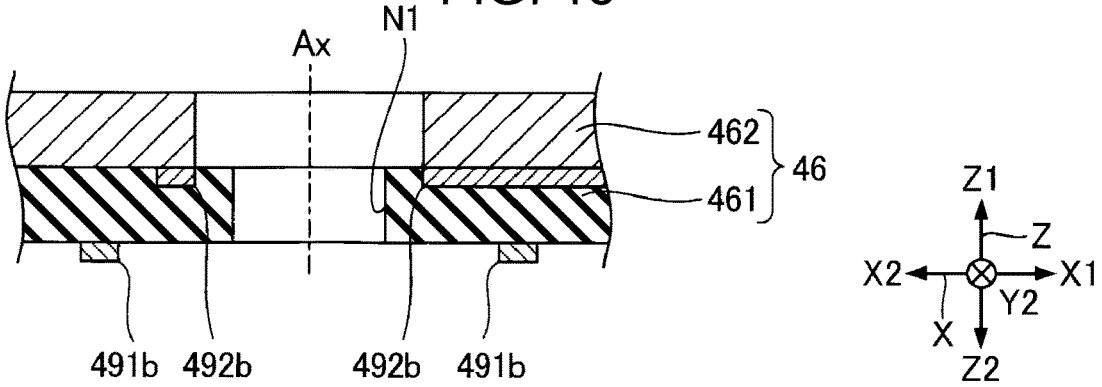
FIG. 13 is a sectional view taken along line XIII-XIII in FIG. 12.

The nozzles N and the surrounding area will be specifically described below to explain the plasma generator 49*b*. FIG. 12 is a magnified plan view of the nozzles N1 and N2 and the surrounding area. FIG. 12 is a plan view illustrating the nozzles N1 and N2 viewed in the Z2 direction. FIG. 13 is a sectional view taken along line XIII-XIII in FIG. 12. The line XIII-XIII is an imaginary line extending in the X axis direction through the central axis Ax of the nozzle N1.

As illustrated in FIGS. 12 and 13, the nozzle substrate 46 in the third embodiment includes the first electrode 491*b* and the second electrode 492*b* of the plasma generator 49*b*. In FIG. 12, although the first and second electrodes 491*b* and 492*b* are not visible, the outlines of the first and second electrodes 491*b* and 492*b* are indicated by broken lines to indicate the position relative to the nozzles N. In FIG. 12, diagonal lines from upper left to lower right indicate the first electrode 491*b* and diagonal lines from upper right to lower left indicate the second electrode 492*b*. As illustrated in FIG. 13, the first electrode 491*b* is disposed on a surface of the nozzle substrate 46 facing in the ejection direction or on the ejection surface F. The first electrode 491*b* is exposed to the atmosphere. As illustrated in FIG. 13, the second electrode 492*b* is disposed between the first substrate 461 and the second substrate 462. The shape of the first electrode 491*b* will be described with reference to FIG. 14 and the shape of the second electrode 492*b* will be described with reference to FIG. 15.

Figure 14:
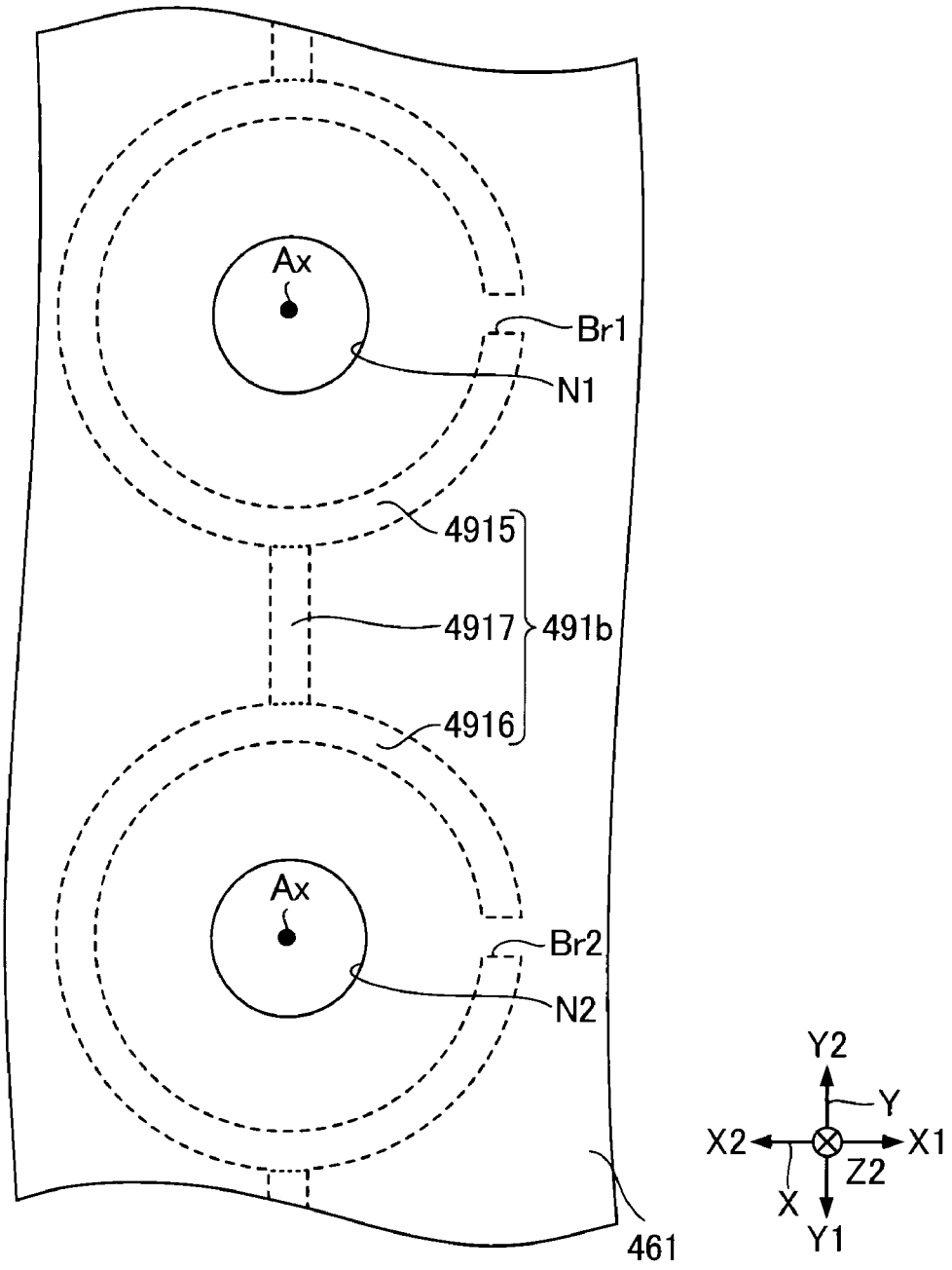
FIG. 14 is a view illustrating a shape of a first electrode.

FIG. 14 illustrates the shape of the first electrode 491*b*. FIG. 14 is a plan view illustrating the first substrate 461 viewed in the Z2 direction. In FIG. 14, although the first electrode 491*b* is not visible, the outline of the first electrode 491*b* is indicated by a broken line to indicate the position relative to the nozzle N.

The first electrode 491*b* includes a fifth electrode portion 4915, a sixth electrode portion 4916, and a seventh electrode portion 4917. The fifth electrode portion 4915 surrounds the nozzle N1. The sixth electrode portion 4916 surrounds the nozzle N2. The seventh electrode portion 4917 couples the fifth electrode portion 4915 and the sixth electrode portion 4916 to each other. The fifth electrode portion 4915 is a metal member having a flat ring shape centered at the central axis Ax of the nozzle N1 and having a cutout Br1 opening in the X1 direction. The sixth electrode portion 4916 is a metal member having a flat ring shape centered at the central axis Ax of the nozzle N2 and having a cutout Br2 opening in the X1 direction. The seventh electrode portion 4917 is a metal member having a flat rectangular shape extending in the Y axis direction. Furthermore, the seventh electrode portion 4917 overlaps the central axis Ax of the nozzle N when viewed in the Y axis direction. The fifth electrode portion 4915 is an example of a "fifth portion". The sixth electrode portion 4916 is an example of a "sixth portion". The seventh portion 4917 is an example of a "seventh portion".

Figure 15:
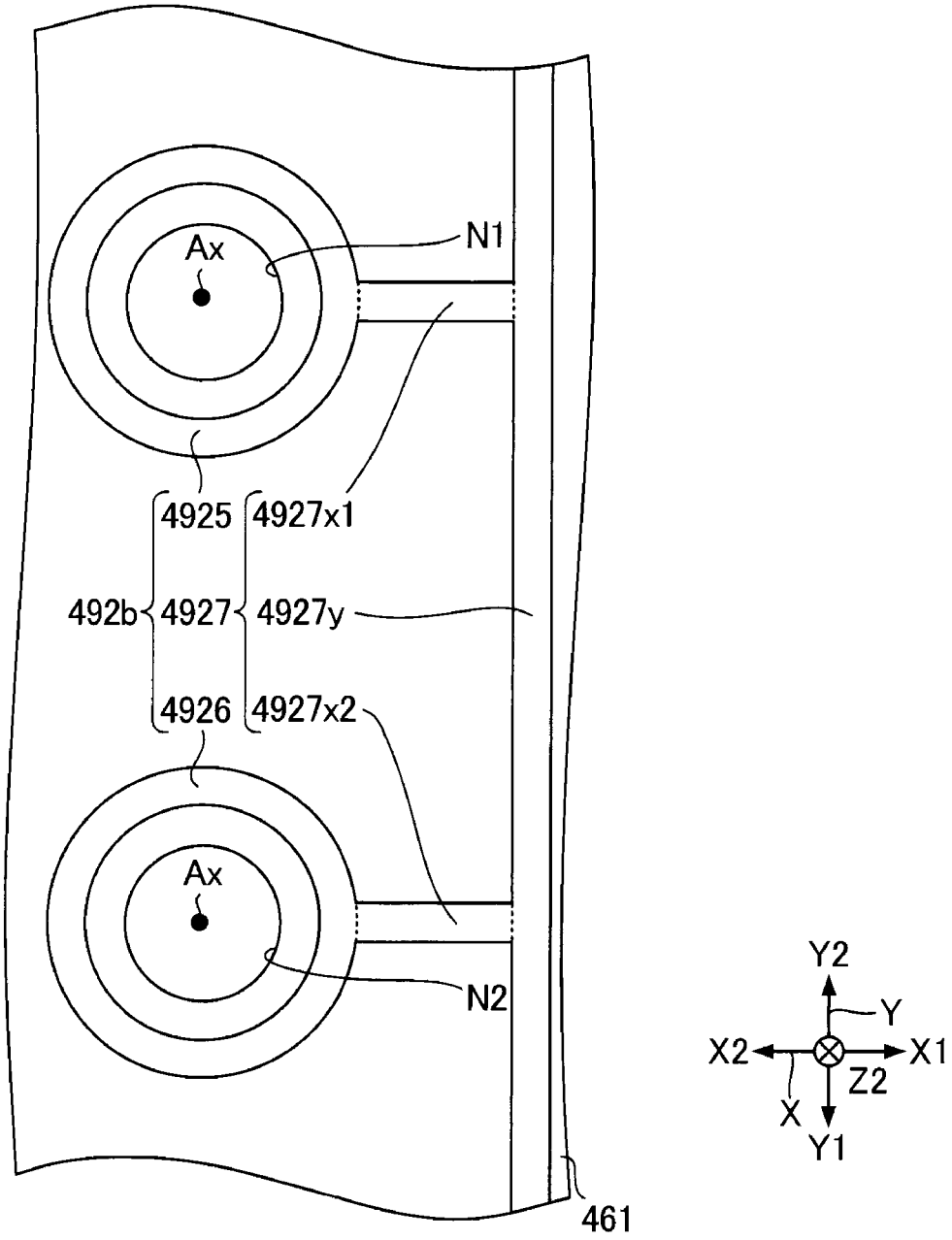
FIG. 15 is a view illustrating a shape of a second electrode.

FIG. 15 illustrates the shape of the second electrode 492*b*. FIG. 15 is a plan view illustrating the first substrate 461 viewed in the Z2 direction.

The second electrode 492*b* includes a fifth electrode portion 4925, a sixth electrode portion 4926, and a seventh electrode portion 4927. The fifth electrode portion 4925 surrounds the nozzle N1. The sixth electrode portion 4926 surrounds the nozzle N2. The seventh electrode portion 4927 couples the fifth electrode portion 4925 and the sixth electrode portion 4926 to each other. The fifth and sixth electrode portions 4925 and 4926 are metal members each having a flat ring shape centered at the central axis Ax of the nozzle N.

The seventh electrode portion 4927 includes electrode portions 4927*x*1, 4927*x*2, and 4927*y*. The electrode portions 4927*x*1 and 4927*x*2 are metal members each having a flat rectangular shape extending in the X axis direction. The electrode portion 4927*y* is a metal member having a flat rectangular shape extending in the Y axis direction. The electrode portion 4927*x*1 is coupled to the fifth electrode portion 4925 at the X2 direction end and coupled to the electrode portion 4927*y* at the X1 direction end. The electrode portion 4927*x*2 is coupled to the sixth electrode portion 4926 at the X2 direction end and coupled to the electrode portion 4927*y* at the X1 direction end. Furthermore, the electrode portion 4927*x*1 overlaps the central axis Ax of the nozzle N1 when viewed in the X axis direction. In the same way, the electrode portion 4927*x*2 overlaps the central axis Ax of the nozzle N2 when viewed in the X axis direction. The electrode portion 4927*y* does not overlap the fifth and sixth electrode portions 4925 and 4926 when viewed in the Y axis direction. The fifth electrode portion 4925 is an example of a "fifth portion". The sixth electrode portion 4926 is an example of a "sixth portion". The seventh electrode portion 4927 is an example of a "seventh portion".

The electrode portion 4927*x*1 overlaps the cutout Br1 in the fifth electrode 4915, which opens in the X1 direction, when viewed in the ejection direction. The width of the cutout Br1 in the fifth electrode portion 4915 is larger than the width of the electrode portion 4927*x*1. Thus, the fifth electrode portion 4915 and the electrode portion 4927*x*1 do not overlap each other when viewed in the Z2 direction. In the same way, the electrode portion 4927*x*2 overlaps the cutout Br2 in the sixth electrode portion 4916 in the ejection direction. The width of the cutout Br2 in the sixth electrode portion 4916 is larger than the width of the electrode portion 4927*x*2. Thus, the sixth electrode portion 4926 and the electrode portion 4927*x*2 do not overlap each other when viewed in the Z2 direction. The electrode portion 4927*y* does not overlap the fifth and sixth electrode portions 4925 and 4926 when viewed in the Y axis direction. In this configuration, the electrode portion 4927*y* and the seventh electrode portion 4917 do not overlap each other when viewed in the Z2 direction.

3.2. Summary of Third Embodiment

As described above, in the third embodiment, the first electrode 491*b* includes the fifth electrode portion 4915 surrounding the nozzle N1, the sixth electrode portion 4916 surrounding the nozzle N2 adjacent to the nozzle N1, and the seventh electrode portion 4917 coupling the fifth electrode portion 4915 and the sixth electrode portion 4916 to each other. In the same way, the second electrode portion 492*b* includes the fifth electrode portion 4925 surrounding the nozzle N1, the sixth electrode portion 4926 surrounding the nozzle N2, and the seventh electrode portion 4927 coupling the fifth electrode portion 4925 and the sixth electrode portion 4926 to each other.

In the third embodiment, the fifth electrode portions 4915 and 4925 surrounding the nozzle N1 allow a jet stream directed in the Z2 direction to be generated at the nozzle N1. In the same way, the sixth electrode portions 4916 and 4926 surrounding the nozzle N2 allow a jet stream directed in the Z2 direction to be generated at the nozzle N2. Thus, as in the second embodiment, the first and second electrodes 491*b* and 492*b* in the third embodiment surround the individual nozzles N. This enables the amount of air flowing from the first electrode 491*b* toward the nozzle N to be larger than that in the first embodiment, generating a greater jet stream. Furthermore, the seventh electrode portion 4917 couples the fifth electrode portion 4915 and the sixth electrode portion 4916 to each other. This eliminates the need for wiring lines coupling the portions surrounding the nozzles N and the AC power 493 to each other, enabling the wiring design to be simpler than that in the second embodiment.

Furthermore, the fifth electrode portion 4915 of the first electrode 491*b* and the seventh electrode portion 4927 of the second electrode 492*b* do not overlap each other when viewed in the Z2 direction. The seventh electrode portion 4917 of the first electrode 491*b* and the fifth electrode portion 4925 of the second electrode 492*b* do not overlap each other when viewed in the Z2 direction. The seventh electrode portion 4917 of the first electrode 491*b* and the seventh electrode portion 4927 of the second electrode 492*b* do not overlap each other when viewed in the Z2 direction.

If the first electrode 491 and the second electrode 492 overlap each other when viewed in the Z2 direction, an airflow will be generated at the overlapping portion, affecting an airflow flowing toward the nozzle N. This may make the jet stream flowing in the Z2 direction smaller. In the third embodiment, when viewed in the Z2 direction, the first electrode 491*b* and the second electrode 492*b* do not overlap each other, reducing generation of the airflow affecting the airflow flowing toward the nozzle N. Thus, the jet stream directed in the Z2 direction is not made smaller.

4. Modifications

The above-described embodiments may be modified in various ways. Specific modifications will be described below as examples. Two or more modifications below may be combined without causing technical inconsistencies.

4.1. First Modification

In the first, second, and third embodiments, the second electrode 492 is disposed between the first substrate 461 and the second substrate 462. However, the present disclosure is not limited to this configuration. For example, the second electrode 492 may be disposed between the nozzle substrate 46 and the channel substrate 32.

Figure 16:
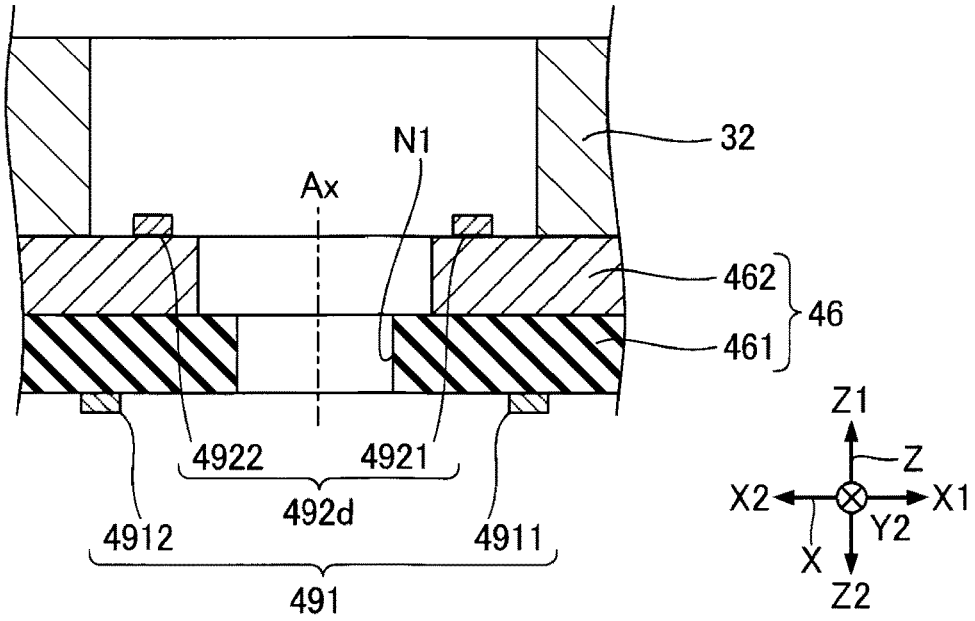
FIG. 16 is a view indicating a position of a second electrode in a first modification.

FIG. 16 indicates the position of a second electrode 492*d* in the first modification. FIG. 16 is a magnified sectional view of the nozzle N1 and the surrounding area in which the liquid ejecting head 26 according to the first modification is taken along the XZ plane extending through the central axis Ax of the nozzle N1. The second electrode 492*d* is disposed between the nozzle substrate 46 and the channel substrate 32. In the first modification, the second substrate 462 is an insulator. In the first modification, the first and second substrates 461 and 462 are components between the first electrode 491 and the second electrode 492*d*.

Although a plan view of the first modification is not illustrated, the second electrode 492*d* has the same shape as the second electrode 492 in the first embodiment. The second electrode 492*d* differs from the second electrode 492 only in position in the Z axis direction.

As described above, in the first modification, the second electrode 492*d* is disposed between the nozzle substrate 46 and the channel substrate 32. Thus, the distance between the first electrode 491 and the second electrode 492 in the first modification is longer than that in the first embodiment. This reduces the possibility that the components between the first electrode 491 and the second electrode 492 will undergo electrical breakdown even if an alternating voltage applied to the first electrode 491 is high.

Although not illustrated, the second electrode 492*a* in the second embodiment may be disposed between the nozzle substrate 46 and the channel substrate 32 as in the first modification. Furthermore, the second electrode 492*b* in the third embodiment may be disposed between the nozzle substrate 46 and the channel substrate 32 as in the first modification.

4.2 Second Modification

The second electrode 492*d* in the first modification is disposed between the nozzle substrate 46 and the channel substrate 32. However, the present disclosure is not limited to this configuration. For example, the second electrode 492 may be disposed between the channel substrate 32 and the pressure chamber substrate 34.

Figure 17:
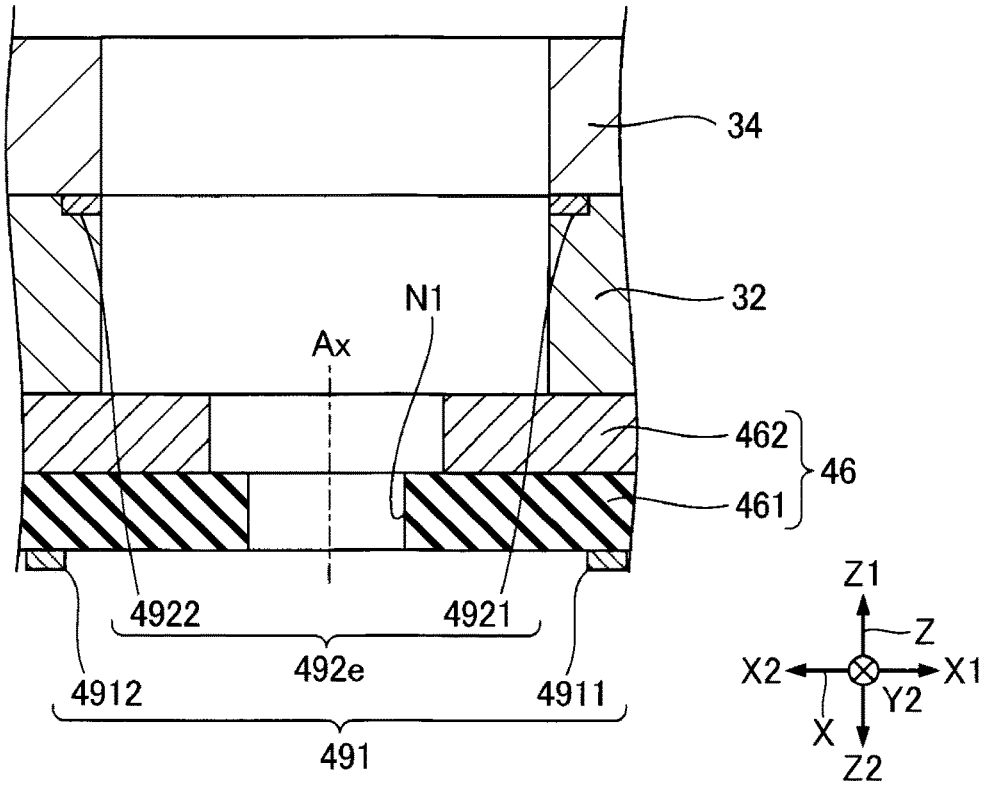
FIG. 17 is a view indicating a position of a second electrode in a second modification.

FIG. 17 indicates the position of a second electrode 492*e* in the second modification. FIG. 17 is a magnified sectional view of the nozzle N1 and the surrounding area in which the liquid ejecting head 26 according to the second modification is taken along the XZ plane extending through the central axis Ax of the nozzle N1. The second electrode 492*e* is disposed between the channel substrate 32 and the pressure chamber substrate 34. In the second modification, the second substrate 462 and the channel substrate 32 are insulators. In the second modification, the first and second substrates 461 and 462 and the channel substrate 32 are components between the first electrode 491 and the second electrode 492*e*.

Although a plan view of the second modification is not illustrated, the second electrode 492*e* has the same shape as the second electrode 492 in the first embodiment. The second electrode 492*e* differs from the second electrode 492 only in position in the Z axis direction.

As described above, the liquid ejecting head 26 in the second modification includes the pressure chamber substrate 34. The pressure chamber substrate 34 has the pressure chamber C in which pressure is applied to the ink such that the ink is ejected through the nozzle N via the channel. The second electrode 492*e* is disposed between the channel substrate 32 and the pressure chamber substrate 34. Thus, the distance between the first electrode 491 and the second electrode 492*e* in the second modification is longer than that in the first modification. This reduces the possibility that the components between the first electrode 491 and the second electrode 492*e* will undergo electrical breakdown even if an alternating voltage applied to the first electrode 491 is high.

Although not illustrated, the second electrode 492*a* in the second embodiment may be disposed between the channel substrate 32 and the pressure chamber substrate 34 as in the second modification. Furthermore, the second electrode 492*b* in the third embodiment may be disposed between the channel substrate 32 and the pressure chamber substrate 34 as in the second modification.

4.3. Third Modification

In the first embodiment, the second electrode 492 has the first and second electrode portions 4921 and 4922 extending in the Y axis direction. However, the present disclosure is not limited to this configuration. For example, the second electrode 492 may have the fifth, sixth, and seventh electrode portions 4925, 4926, and 4927 of the second electrode 492*b* in the third embodiment.

4.4. Fourth Modification

In the third embodiment, the seventh electrode portion 4917 of the first electrode 491*b* overlaps the central axis Ax of the nozzle N when viewed in the Y axis direction. However, the seventh electrode portion 4917 is only required to be away from the seventh electrode portion 4927 when viewed in the Z2 direction. For example, the seventh electrode portion 4917 may overlap the X1 direction end of the fifth electrode portion 4915 or may overlap the X2 direction end of the fifth electrode portion 4915 when viewed in the Y axis direction.

4.5. Fifth Modification

In the first embodiment, the arrangement direction of the nozzles N and the wiping direction in which the wiping mechanism 284 wipes the ejection surface F are the same. In contrast, in the second and third embodiments, the arrangement direction of the nozzles N and the wiping direction are not required to be the same. Thus, in the second and third embodiments, the arrangement direction of the nozzles N is not limited to the Y axis direction, which is the wiping direction, and may intersect the X axis direction and the Y axis direction.

4.6. Sixth Modification

In the above-described embodiments, the piezoelectric elements 38, which convert electrical energy to kinetic energy, are used as an energy conversion element that applies pressure to the inside of the pressure chamber C. However, the present disclosure is not limited to this configuration. The energy conversion element that applies pressure to the inside of the pressure chamber C may be a heating element. The heating element converts electrical energy to thermal energy and generates air bubbles in the pressure chamber C by heat to change the pressure in the pressure chamber C. The heating element may include a heating element that produces heat upon reception of the driving signal Com, for example.

4.7. Seventh Modification

In the above-described embodiments, the liquid ejecting apparatus is a serial liquid ejecting apparatus in which the carriage 242 having the liquid ejecting head 26 is reciprocated. However, the present disclosure may be applied to a line liquid ejecting apparatus that has nozzles N arranged over the entire width of the medium 12.

4.8. Eighth Modification

The liquid ejecting apparatus 100 according to the above-described embodiments may be employed in a print-only device or other devices such as a facsimile machine and a copier. The liquid ejecting apparatus may be used for any purpose other than printing. For example, a liquid ejecting apparatus that ejects a solution of a color material may be employed in a production apparatus that forms a color filter of a display panel such as a liquid crystal display panel. Furthermore, a liquid ejecting apparatus that ejects a solution of a conductive material may be employed in a production apparatus that forms wiring lines and electrodes on a wiring board. Furthermore, a liquid ejecting apparatus that ejects a solution of a biological organic substance may be employed in a production apparatus that forms biochips.

What is claimed is:

1. A liquid ejecting head comprising:

a channel substrate having a channel through which a liquid flows;

a nozzle substrate having a nozzle through which the liquid supplied through the channel is ejected in an ejection direction, the nozzle substrate being stacked on the channel substrate in the ejection direction;

the liquid ejecting head further comprising a plasma generator which includes a first electrode and a second electrode and in which an alternating voltage is applied to at least the first electrode to generate an atmospheric-pressure plasma around the first electrode, the atmospheric-pressure plasma accelerating the liquid ejected through the nozzle, wherein the first electrode is disposed on a surface of the nozzle substrate in the ejection direction, the second electrode is disposed opposite the first electrode in the ejection direction, and the first electrode is farther than the second electrode from the nozzle in an intersecting direction intersecting the ejection direction.

2. The liquid ejecting head according to claim 1, wherein the nozzle substrate has a plurality of nozzles, the nozzle is a first nozzle of the plurality of nozzles, and the first electrode includes a first portion and a second portion, the first portion extending in an arrangement direction of the plurality of nozzles and being located, with respect to the first nozzle, in one of two directions intersecting the ejection direction and the arrangement direction, the second portion extending in the arrangement direction and being located, with respect to the first nozzle, in the other of the two directions.

3. The liquid ejecting head according to claim 2, wherein the second electrode includes a first portion and a second portion, the first portion extending in the arrangement direction and being located, with respect to the first nozzle, in the one of the two directions intersecting the ejection direction and the arrangement direction, the second portion extending in the arrangement direction and being located, with respect to the first nozzle, in the other of the two directions.

4. The liquid ejecting head according to claim 1, wherein the nozzle substrate has a plurality of nozzles, the nozzle is a first nozzle of the plurality of nozzles, and the first electrode has a third portion surrounding the first nozzle and a fourth portion surrounding a second nozzle of the plurality of nozzles, and the second electrode has a third portion surrounding the first nozzle and a fourth portion surrounding the second nozzle.

5. The liquid ejecting head according to claim 1, wherein the nozzle substrate has a plurality of nozzles, the nozzle is a first nozzle of the plurality of nozzles, and the first electrode has a fifth portion surrounding the first nozzle, a sixth portion surrounding a second nozzle of the plurality of nozzles, the second nozzle being adjacent to the first nozzle, and a seventh portion coupling the fifth portion and the sixth portion, and the second electrode has a fifth portion surrounding the first nozzle, a sixth portion surrounding the second nozzle, and a seventh portion coupling the fifth portion and the sixth portion.

6. The liquid ejecting head according to claim 5, wherein the fifth portion of the first electrode and the seventh portion of the second electrode do not overlap each other when viewed in the ejection direction, the seventh portion of the first electrode and the fifth portion of the second electrode do not overlap each other when viewed in the ejection direction, and the seventh portion of the first electrode and the seventh portion of the second electrode do not overlap each other when viewed in the ejection direction.

7. The liquid ejecting head according to claim 1, wherein the nozzle substrate includes a first substrate and a second substrate stacked on the first substrate in a direction opposite the ejection direction, and the second electrode is disposed between the first substrate and the second substrate.

8. The liquid ejecting head according to claim 1, wherein the second electrode is disposed between the nozzle substrate and the channel substrate.

9. The liquid ejecting head according to claim 1, further comprising a pressure chamber substrate having a pressure chamber configured to apply pressure to the liquid such that the liquid is ejected through the nozzle via the channel, the pressure chamber substrate being stacked on the channel substrate in a direction opposite the ejection direction, wherein the second electrode is disposed between the channel substrate and the pressure chamber substrate.

10. The liquid ejecting head according to claim 1, wherein the first electrode is exposed to atmosphere.

11. The liquid ejecting head according to claim 1, wherein the alternating voltage is applied in the plasma generator to generate an atmospheric-pressure plasma such that the alternating voltage does not exceed an electrical breakdown voltage of a component disposed between the first electrode and the second electrode.

12. The liquid ejecting head according to claim 1, wherein a component disposed between the first electrode and the second electrode is an insulator.

13. The liquid ejecting head according to claim 1, wherein the nozzle substrate is formed to include at least one of silicon, silicon oxide, silicon nitride, and a photocurable resin.

14. The liquid ejecting head according to claim 1, wherein the plasma generator is configured to generate an atmospheric-pressure plasma after the liquid is ejected through the nozzle and before a predetermined time passes.

15. A liquid ejecting apparatus comprising:

the liquid ejecting head according to claim 1; and an ejection controller configured to control ejection from the liquid ejecting head.

16. A liquid ejecting head comprising:

a channel substrate having a channel through which a liquid flows;

a nozzle substrate having a nozzle through which the liquid supplied through the channel is ejected in an ejection direction, the nozzle substrate being stacked on the channel substrate in the ejection direction;

the liquid ejecting head further comprising a plasma generator which includes a first electrode and a second electrode and in which an alternating voltage is applied to at least the first electrode to generate an atmospheric-pressure plasma around the first electrode, the atmospheric-pressure plasma accelerating the liquid ejected through the nozzle, wherein the first electrode is disposed on a surface of the nozzle substrate in the ejection direction, the second electrode is disposed opposite the first electrode in the ejection direction, the nozzle substrate has a plurality of nozzles, the nozzle is a first nozzle of the plurality of nozzles, and the first electrode includes a first portion and a second portion, the first portion extending in an arrangement direction of the plurality of nozzles and being located, with respect to the first nozzle, in one of two directions intersecting the ejection direction and the arrangement direction, the second portion extending in the arrangement direction and being located, with respect to the first nozzle, in the other of the two directions.

17. A liquid ejecting head comprising:

a channel substrate having a channel through which a liquid flows;

a nozzle substrate having a nozzle through which the liquid supplied through the channel is ejected in an ejection direction, the nozzle substrate being stacked on the channel substrate in the ejection direction;

the liquid ejecting head further comprising a plasma generator which includes a first electrode and a second electrode and in which an alternating voltage is applied to at least the first electrode to generate an atmospheric-pressure plasma around the first electrode, the atmospheric-pressure plasma accelerating the liquid ejected through the nozzle, wherein the first electrode is disposed on a surface of the nozzle substrate in the ejection direction, the second electrode is disposed opposite the first electrode in the ejection direction, wherein the nozzle substrate has a plurality of nozzles, the nozzle is a first nozzle of the plurality of nozzles, and the first electrode has a third portion surrounding the first nozzle and a fourth portion surrounding a second nozzle of the plurality of nozzles, and the second electrode has a third portion surrounding the first nozzle and a fourth portion surrounding the second nozzle.

* * * * *